US010011995B2

(12) United States Patent
Monteer

(10) Patent No.: US 10,011,995 B2
(45) Date of Patent: Jul. 3, 2018

(54) BUILDING SIDING METHOD AND APPARATUS

(71) Applicant: Shaun R. Monteer, Eagle Mountain, UT (US)

(72) Inventor: Shaun R. Monteer, Eagle Mountain, UT (US)

( * ) Notice: Subject to any disclaimer, the term of this patent is extended or adjusted under 35 U.S.C. 154(b) by 0 days.

(21) Appl. No.: 14/484,252

(22) Filed: Sep. 11, 2014

(65) Prior Publication Data

US 2015/0068148 A1 Mar. 12, 2015
US 2015/0275525 A9 Oct. 1, 2015

Related U.S. Application Data

(63) Continuation-in-part of application No. 13/581,466, filed as application No. PCT/US2011/000344 on Feb. 25, 2011, now Pat. No. 9,079,380.
(Continued)

(51) Int. Cl.

| | |
|---|---|
| ***E04B 7/00*** | (2006.01) |
| ***E04F 13/00*** | (2006.01) |
| ***E04F 13/073*** | (2006.01) |
| ***E04F 13/08*** | (2006.01) |
| ***E04D 13/158*** | (2006.01) |
| ***E04B 1/70*** | (2006.01) |

(Continued)

(52) U.S. Cl.
CPC ..... *E04F 13/007* (2013.01); *E04B 1/7069* (2013.01); *E04D 13/158* (2013.01); *E04F 13/075* (2013.01); *E04F 13/076* (2013.01); *E04F 13/0733* (2013.01); *E04F 13/0862* (2013.01); *E04F 13/0864* (2013.01); *E04F 13/0869* (2013.01); *E04F 13/0892* (2013.01); *E04F 13/24* (2013.01); *E04B 2001/405* (2013.01)

(58) Field of Classification Search
CPC . E04F 13/0864; E04F 13/0842; E04F 13/007; E04F 13/24; E04F 13/076; E04F 13/075; E04F 13/0869; E04F 13/0862; E04F 13/0733; E04F 13/0892; E04C 2/38; E04B 1/7069; E04B 2001/405; E04D 13/158
USPC ..... 52/302.1, 302.2, 302.6, 302.7, 57, 198, 52/199, 287.1, 288.1
See application file for complete search history.

(56) References Cited

U.S. PATENT DOCUMENTS 2,009,056 A 7/1935 Schaffert
2,164,725 A 7/1939 Snyder
(Continued)

FOREIGN PATENT DOCUMENTS

WO WO 2011106095 A1 * 9/2011

*Primary Examiner* — Basil Katcheves
*Assistant Examiner* — Joshua Ihezie
(74) *Attorney, Agent, or Firm* — Geoffrey E. Dobbin; Dobbin IP Law

(57) ABSTRACT

A system for providing siding to a building is disclosed. The system utilizes components which have their own brackets with attachment flanges in order to connect directly to an exterior wall of the building. The brackets contain their own integrated water control systems, which co-act with those of other components to control and direct water into vertical channels and out from behind the siding system. These flanges double as self-contained flashing. In all the system presents a roof-to-foundation siding system that is self-contained and fully transitional from one piece to another.

1 Claim, 29 Drawing Sheets

Related U.S. Application Data

(60) Provisional application No. 61/876,378, filed on Sep. 11, 2013, provisional application No. 61/338,863, filed on Feb. 25, 2010.

(51) Int. Cl.

| | |
|---|---|
| ***E04F 13/075*** | (2006.01) |
| ***E04F 13/076*** | (2006.01) |
| ***E04F 13/24*** | (2006.01) |
| *E04B 1/38* | (2006.01) |

(56) References Cited

U.S. PATENT DOCUMENTS 2,307,787 A 1/1943 Morrell
2,329,610 A 9/1943 Harman
2,351,856 A 6/1944 Henderson
2,497,887 A 2/1950 Hilpert
2,664,835 A 1/1954 Sorensen
2,769,212 A 11/1956 Hammitt et al.
2,791,117 A 5/1957 Bailey
3,110,130 A * 11/1963 Trachtenberg Sam Z ..... 52/545
3,174,590 A 3/1965 Haker
3,234,074 A 2/1966 Bryant
3,245,185 A 4/1966 Rowe
3,300,934 A 1/1967 Waizenhofer
3,328,934 A 7/1967 Hall
3,336,709 A 8/1967 Berney et al.
3,462,897 A 8/1969 Weinrott
3,462,898 A 8/1969 Balency-Bearn
3,462,903 A 8/1969 Kronbetter
3,481,087 A 12/1969 Stafford
3,525,188 A * 8/1970 Torbett ..... E04F 13/08 52/288.1
3,555,754 A 1/1971 Kellogg
3,661,688 A 5/1972 Wheeler
3,690,086 A 9/1972 Cole et al.
3,763,606 A 10/1973 Rindebong
3,820,296 A 6/1974 Bebinger
3,864,881 A 2/1975 Wolf
3,895,469 A 7/1975 Kapitan
3,959,941 A 6/1976 Smith
4,189,885 A * 2/1980 Fritz ..... E04F 19/06 52/278
4,319,439 A * 3/1982 Gussow ..... E04F 19/024 52/288.1
4,594,829 A 6/1986 Herrgord
4,947,601 A 8/1990 McGuire
5,090,174 A * 2/1992 Fragale ..... E04C 2/292 52/276
5,212,914 A 5/1993 Martin et al.
5,425,210 A 6/1995 Zafir
5,517,794 A * 5/1996 Wagner ..... E04F 19/02 403/110
5,542,222 A * 8/1996 Wilson ..... E04F 13/0864 52/276
5,575,127 A * 11/1996 O'Neal ..... 52/520
5,664,376 A * 9/1997 Wilson ..... E04F 13/0864 52/287.1
5,836,123 A * 11/1998 Gulino ..... E04F 19/024 52/288.1
5,918,430 A 7/1999 Rowland
6,029,418 A 2/2000 Wright
6,219,980 B1 * 4/2001 Peck, Jr. ..... E04F 19/028 52/255
6,289,646 B1 * 9/2001 Watanabe ..... 52/506.01
6,311,442 B1 * 11/2001 Watanabe ..... E04B 2/707 156/91
6,334,283 B1 1/2002 Edger
6,341,458 B1 * 1/2002 Burt ..... E04F 13/0864 52/287.1
6,631,600 B2 * 10/2003 Schiedegger ..... E04F 19/024 52/287.1
7,434,358 B2 10/2008 Smith
7,472,521 B2 1/2009 Bilge
7,487,623 B2 * 2/2009 Rodolofo et al. ..... 52/716.1
7,530,204 B2 5/2009 Cook et al.
7,654,045 B2 2/2010 Wiegel
7,654,050 B2 * 2/2010 Justice ..... E04F 13/0864 52/276
7,980,042 B2 7/2011 Polk, Jr.
8,104,234 B1 * 1/2012 Sawyer ..... 52/96
8,272,190 B2 9/2012 Schiffmann et al.
8,555,581 B2 10/2013 Amend
8,596,000 B2 * 12/2013 Mitchell et al. ..... 52/288.1
8,733,043 B1 * 5/2014 Cashman ..... 52/287.1
2003/0226327 A1 * 12/2003 Perry ..... E04F 13/0864 52/287.1
2008/0302049 A1 12/2008 Stoneburner
2009/0056252 A1 * 3/2009 Taylor ..... E04F 19/061 52/287.1
2009/0272055 A1 11/2009 Griffiths
2009/0313928 A1 12/2009 Montgomery
2010/0212234 A1 * 8/2010 Monteer ..... 52/95
2010/0242387 A1 * 9/2010 Cashman ..... E04F 19/061 52/287.1
2010/0251647 A1 10/2010 Enns
2010/0263316 A1 * 10/2010 Bruneau ..... 52/546
2011/0047891 A1 3/2011 Andretich
2011/0113712 A1 5/2011 Liu
2012/0328823 A1 * 12/2012 Monteer ..... 428/99
2013/0036699 A1 * 2/2013 Holt ..... 52/509

* cited by examiner

BUILDING SIDING METHOD AND APPARATUS

CROSS-REFERENCES TO RELATED APPLICATIONS

This application claims priority as a non-provisional perfection of prior filed U.S. provisional application No. 61/876,378 and incorporates the same by reference herein in its entirety.

FIELD OF THE INVENTION

The present invention relates to the field of construction and more particularly relates to a system for placing siding on a building and the components of said system.

BACKGROUND OF THE INVENTION

Siding is often used to provide a building with both an attractive and a protective finish. Typical siding systems involve panels of a weather-resistant material fastened directly to an exterior wall of a building. In the past, this has required nails or other fasteners to be thrust through the panel and into the exterior wall, inherently causing damage to both and providing a passage for water to seep into the space between the panel and the wall. Older systems were also limited in their ability to expand and contract with environmental changes affecting the building on which such systems were used. There have been some modifications in more recent times. Current siding and trim systems in the market include James Hardie trims and LP SmartSide trims. These trims are face nailed to the exterior of the building and provide some cosmetic enhancements and protection to the buildings. However, these trims are limited because they are still not sufficiently waterproof. In particular, these systems do not provide air gaps and water traps to protect the trim and building from moisture and different climates. Further, these trims are caulked, which causes tears in the trims when expanding and compressing due to environmental conditions such as different climates and air pressure changes. These tears allow water to seep in the trim and onto the structure underneath the trim, where water is being trapped between the backside of trim and the building causing structural damage to the trim and even more serious causing dry-rot and mold as well as structural damage to the building structure itself. As a result, these trims and the structure itself are subject to extensive dry-rot and mold and costly structural damage due to water entrapment, face nailing, nail pops and blemishes, caulk tarring, shrinking and drying out, lack of air movement, constant expansion and contraction ending in cosmetic damage such as, splitting trim and warping, dry rot and mold to the trims and potentially the building structure itself.

As such, there is a need in the industry for a cost effective siding and system for use on buildings that is pliable to expand and compress when in the presence of different environmental conditions. There is a further need in the industry for a waterproof siding and trim system that effectively prevents moisture buildup and damage to the siding and trim and more importantly the building structure itself. The present invention is such a system.

The present invention represents a departure from the prior art in that the siding system of the present invention is comprised of various interacting components, each being set off from the exterior walls of the buildings on which the system is used and having limited but secure attachment thereon. The components have limited attachment to each other, thereby allowing for expansion and contraction of the building. The components also feature water control structures and each component terminates with a transitional finish to at least one other component in the system.

SUMMARY OF THE INVENTION

In view of the foregoing disadvantages inherent in the known types of siding systems, this invention provides a siding system which is cost effective to manufacture and install with less damage to the building and the system components and provides more weather and water resistance to the structure on which it is installed. As such, the present invention's general purpose is to provide a new and improved siding system that is easily and efficiently installed and effective in weatherproofing a building.

To accomplish these objectives, the system comprises numerous components, each comprising at least one weather resistant panel and at least one bracket. Each bracket presents an attachment flange used to connect the component to the exterior wall of the building and also has water containment and control elements inherently manufactured thereon. The term "panel" is used liberally in this specification and the appended claims and include any finishing surface of the component. As such the term includes the obvious planks and siding boards and also corner pieces, door and window trim, and other finishing components that are not necessarily flat. The components are limited in their contact with the exterior wall to create air passageways therebetween. A limited number of types of interfaces are used so that the components of the system are readily and easily fitted together to enhance efficiency in the installation.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the siding system and its constituent components is herein described. It should be noted that the articles "a", "an", and "the", as used in this specification, include plural referents unless the content clearly dictates otherwise.

Figure 1:
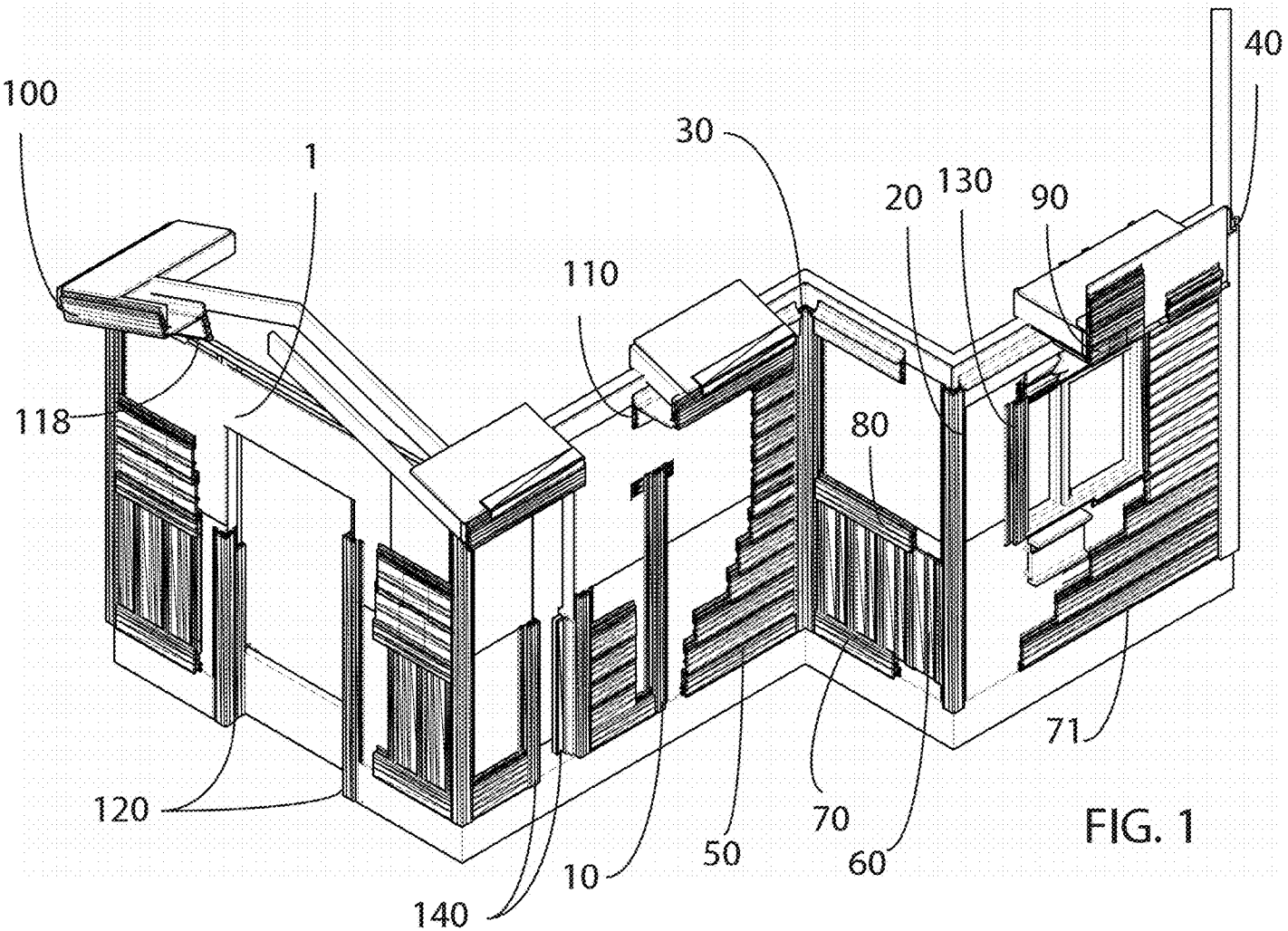
FIG. 1 is a perspective view of a building utilizing embodiments of the method and apparatus, in a state of partial completion.
Figure 40:
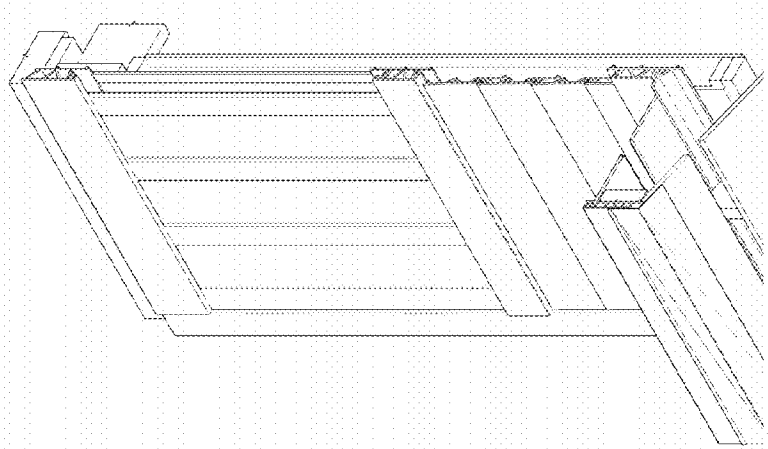
FIG. 40 is a partial perspective view of a building sided according to the present invention.

With reference to FIG. 1, the system itself is illustrated as being partially installed on a building, such as the depicted house. It should be noted that the primary intended use of the system is for dwellings, but the principles and teachings of the invention may be applied to any suitable structure and, as such, the use of a house in the figures and any reference to a "home" or "dwelling" should not be considered limiting. As can be seen in FIG. 1, the system comprises a number of components; however these components are relatively easily categorized. First you have support structures such as outer corners 20, inner corners 30, adjustable corners 40, mullions 10 and aprons 70, 80, 90. Second you have covering components, which are meant to cover large areas of the building, such as shingle planks 50 and board and batten planks 60. Finally, you have finishing or specialty pieces such as door trim 140 and window trim 130, garage door trim 120, frieze boards 110 and fascia 100. Each piece may be vertically oriented, like the board and batten plank and corners, or horizontally oriented, like the siding planks and aprons. As such there is one interface for vertical pieces to mate with other pieces. There is one standard interface for horizontal pieces and one for the specialty siding plank pieces. Finishing components will also have special mounting and interface strategies. The system, as seen in FIGS. 1 and 40, covers the entirety of a building exterior from roof single down to the foundation. The components of this system inherently contain their own flashing in the form of the flanges, thus cutting material cost and installation labor.

The construction of the components is simple. The panel is manufactured from any durable material of choice. The ideal material, as found by the inventor, is a polymer/wood composite which may be extruded to size and shape. Any shape may be utilized, including giving a staggered shingle or a Dutch single look to planks, using rounded or squared edges, etc. Panels and brackets may also be orthogonal or may be angled to accommodate gabled roofs. Brackets are ideally made of durable polymers with limited give so as to resist the effects of gravity and other forces. It is incumbent upon both these materials that they be relatively easily cut to size as buildings will rarely conform to standard lengths and widths of wall. Ultimately, each major component has at least one bracket that extends significantly beyond one edge of the panel and is utilized both for the attachment of the component to the exterior wall of the building and for waterproofing. In an effort to keep each component minimally adjacent the exterior wall, spacers, like the one underneath the attachment strip, are positioned at various places on the back of the panel and the bracket. These spacers, or "standees" may be as simple as a thin strip or bead along an edge, a post, or may be more significant and be, in essence, a separate bracket.

Figure 2:
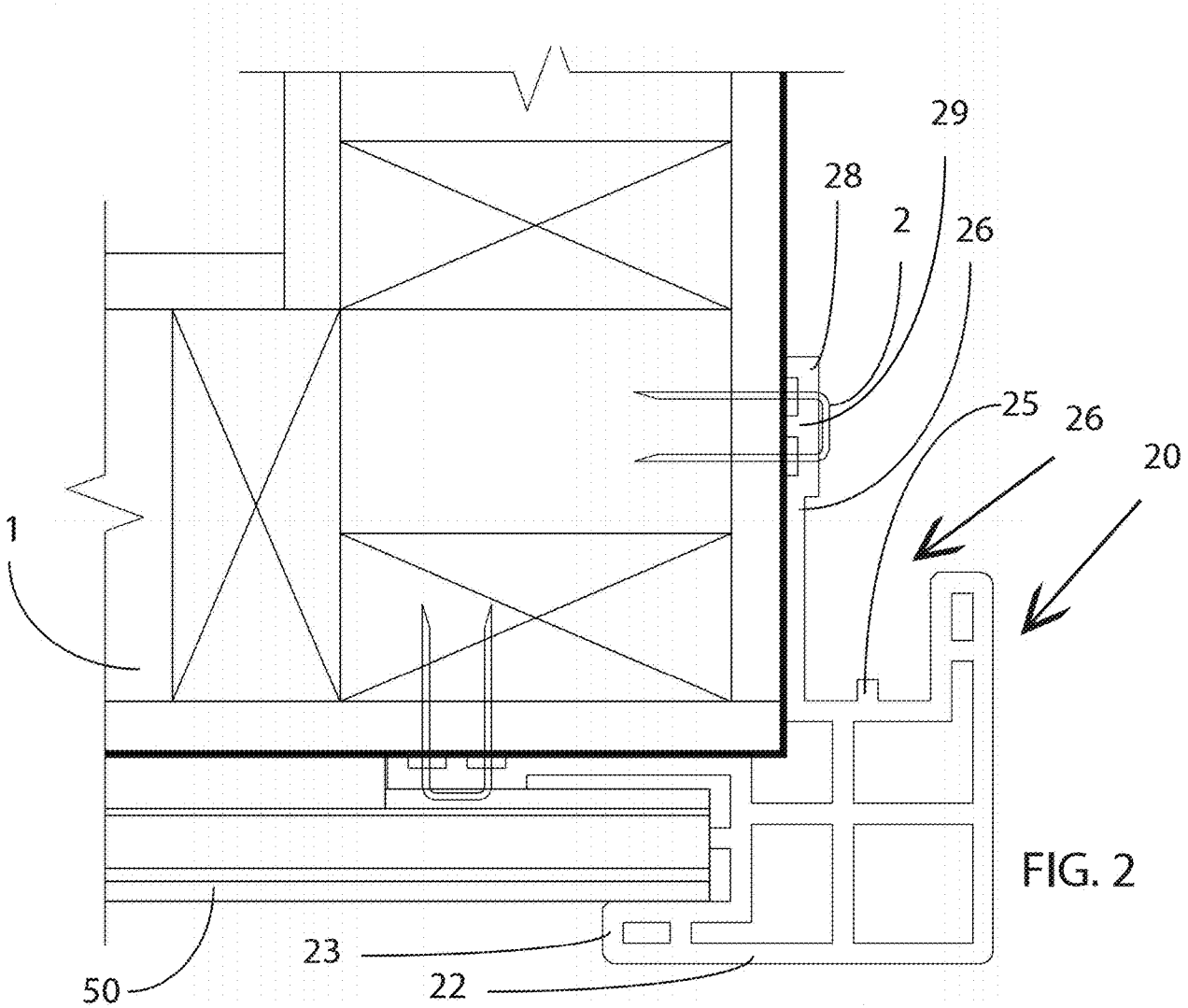
FIG. 2 is a sectional view of an outer corner component installed on an exterior wall.

In assembling the siding system, each component's bracket 26 has an attachment strip 28, as shown with the outside corner piece 20 in FIG. 2, located beyond the edge 23 of the component panel 22. Ideally, this attachment strip 28 is provided for industrial staples 2. The spacer 29 underneath the attachment strip may then be straddled by staples. Each bracket contains a trough 26 located in a position obscured by the panel 22. For the standard interface, the trough serves two purposes: 1. interface for individual components to co-operate; and 2. water control and diversion. The trough in the standard interface is found running vertically in the corner pieces and horizontally in aprons and finishing pieces which interface with the narrow side of board and batten panels. Each trough 26 presents a trough spacer 25 so as to keep the individual pieces from tightly abutting each other while still maintaining a secure assembly. The trough spacer 25, then, stands each piece off from each other so as to allow air and water to flow through the trough and in and around the component and the exterior wall 1. In this way, horizontal troughs remain open to the vertical troughs and allow spillage of water in a controlled manner into the vertical troughs and away from the exterior wall. By joints being obscured by the panel, assembly of individual components into the troughs 26 will allow each piece to transition into a finished assembly with an appealing look.

Figure 3:
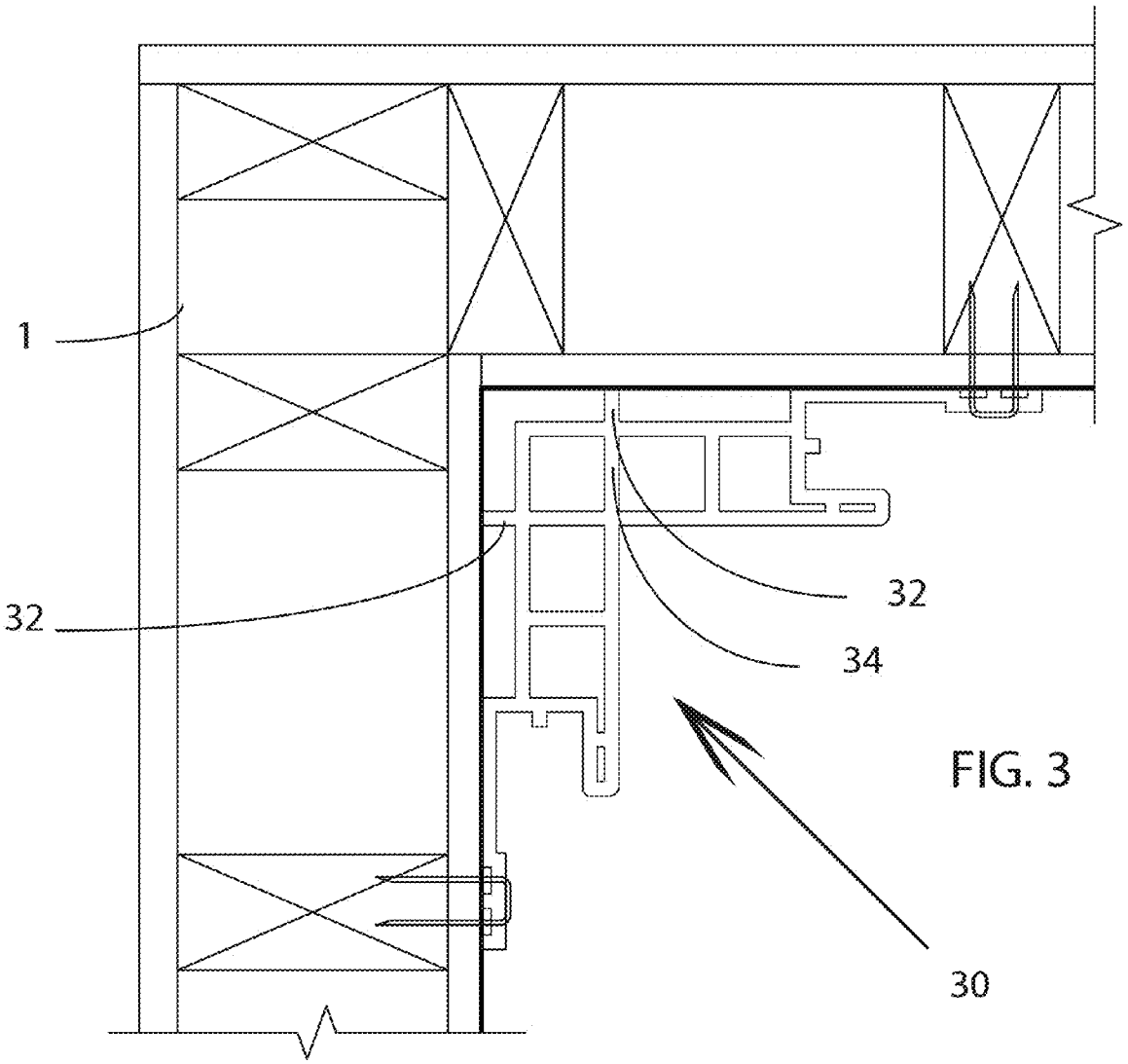
FIG. 3 is a sectional view of an inner corner component installed on an exterior wall.
Figure 4:
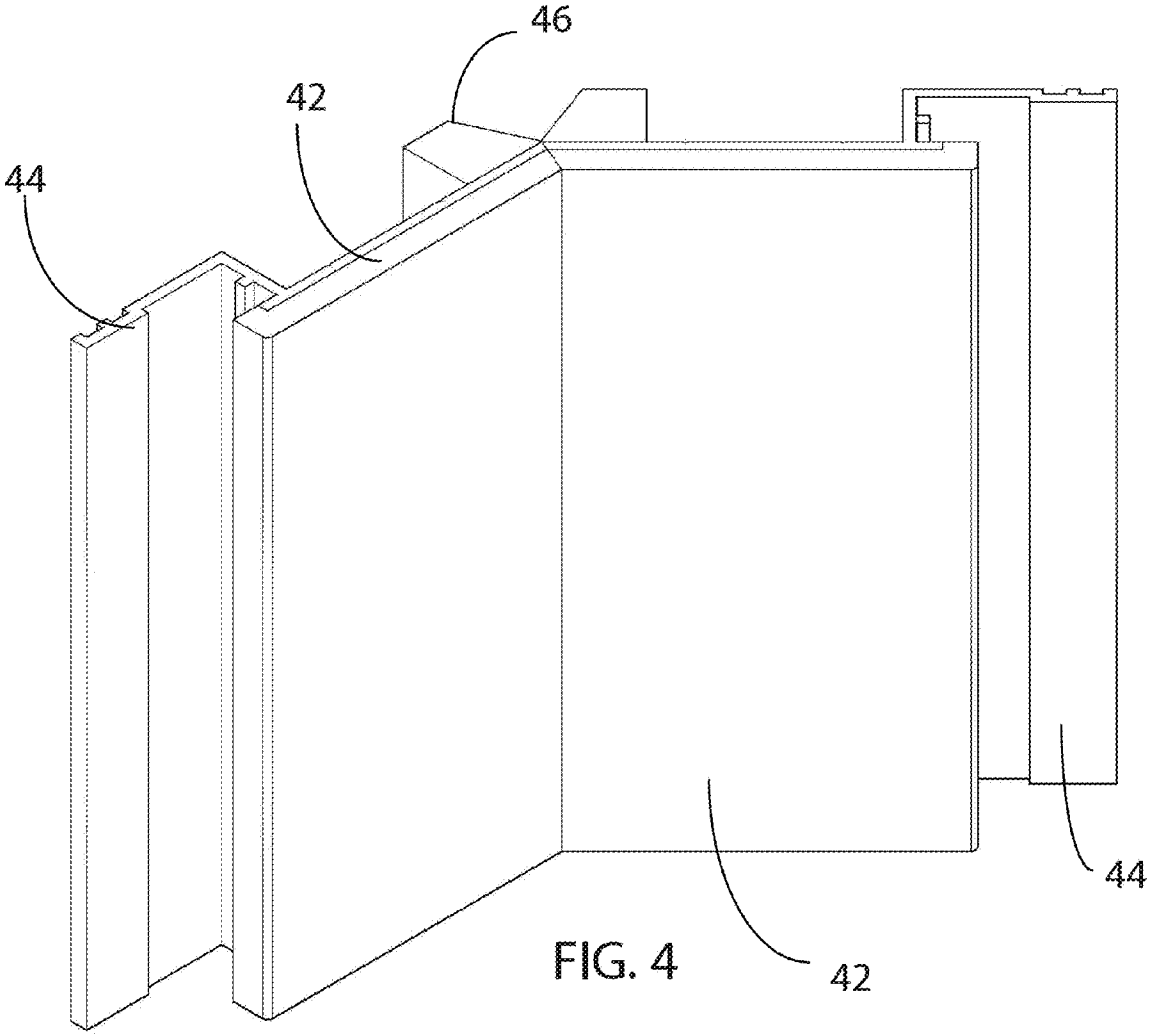
FIG. 4 is a perspective view of a customizable corner component.
Figure 6:
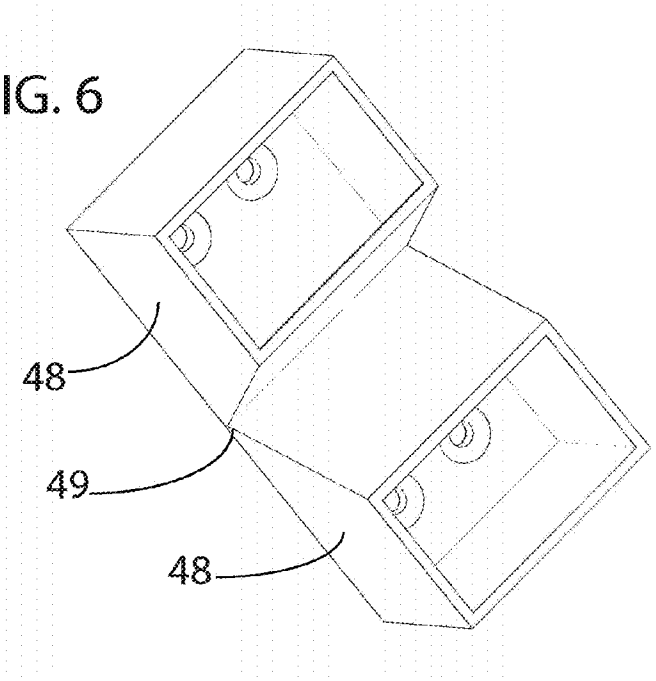
FIG. 6 is a perspective view of the corner support utilized in the customizable corner component of FIG. 4.
Figure 5:
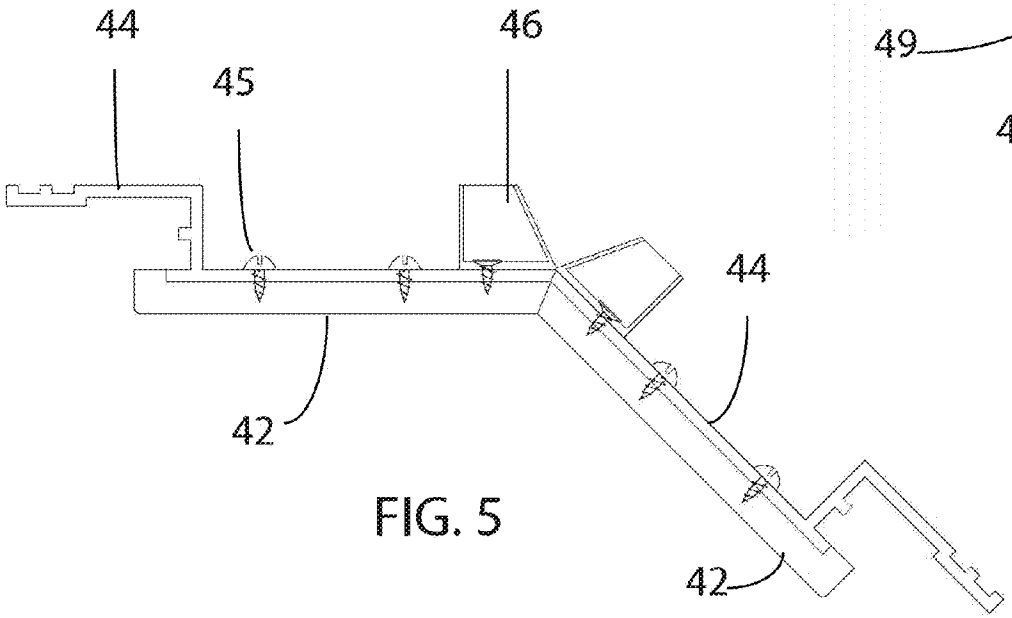
FIG. 5 is a sectional view of the customizable corner component of FIG. 4.
Figure 7:
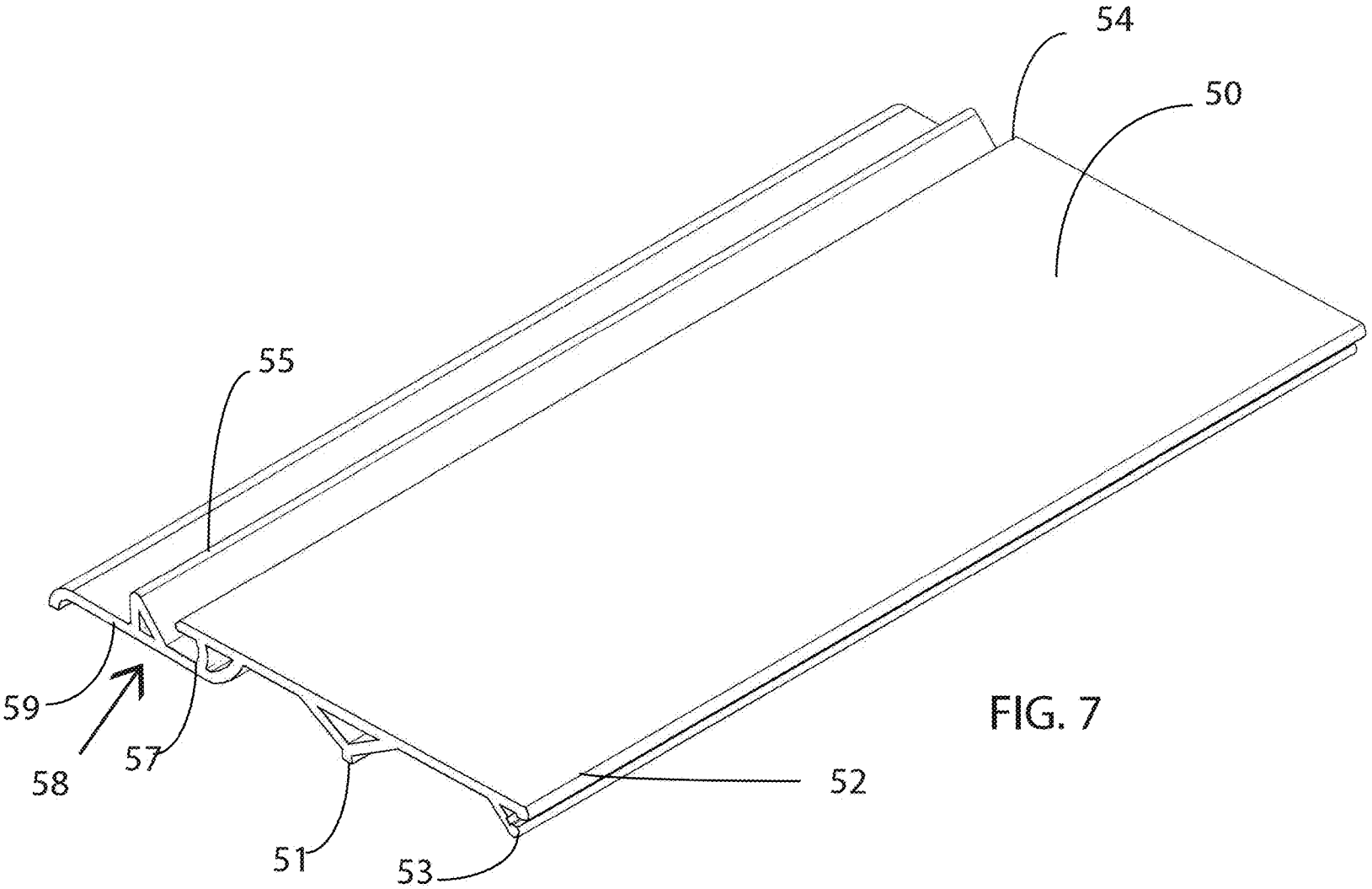
FIG. 7 is a perspective view of a siding plank component.
Figure 8:
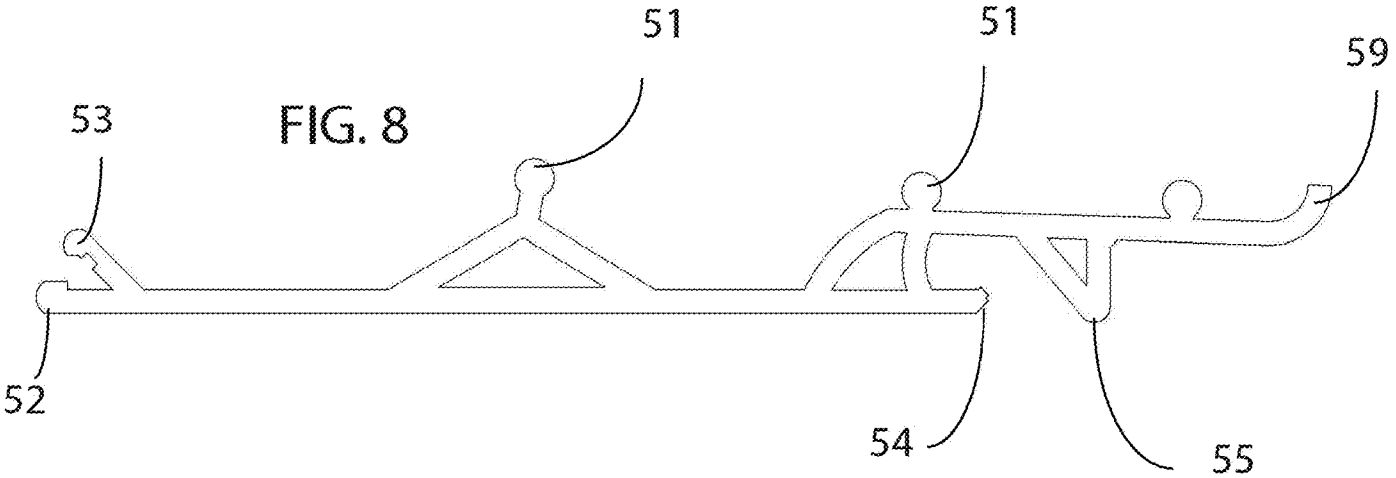
FIG. 8 is a side elevation of the siding plank component of FIG. 7

Corner panels are provided in three types, outer corner panels 20 (FIG. 2), inner corner panels 30 (FIG. 3) and adjustable corner panels 40 (FIGS. 4-6). Each uses the same trough construction. The outer corner panel 20 utilizes its brackets 26 to sand off from the wall. Inner corner 30 uses additional spacers 32 extending off of its support structure 34 to serve as standees. For non-orthogonal corners, a specialized corner component 40 is provided. The component features two panels 42 with detachable brackets 44 and a specialized, flexible corner brace 46. The brackets 44 and panels 42 are mitered along their adjacent edges to the specified angle and attached to each other. Brace 46 is essentially two broad legs 48 joined at a hinge 49. Brace 46 is then bent around the corner and joins the two halves of the corner component 40 together, usually held by screws 45. This component is one where caulking and/or gluing is necessary to assure adequate weatherproofing and structural integrity. Each bracket 44 contains one trough 26 according to the designs already described.

Figure 9:
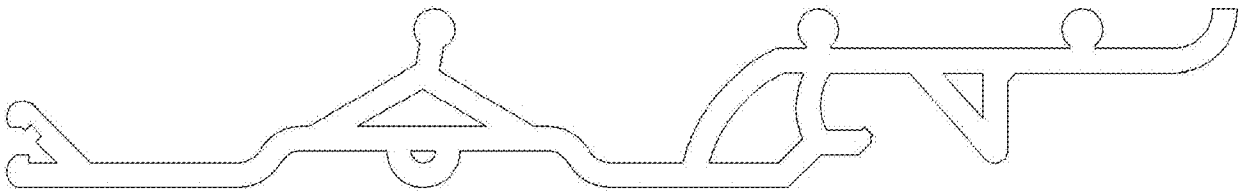
FIG. 9 is an alternate embodiment of the siding plank component.
Figure 13:
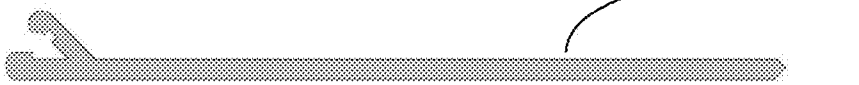
FIG. 13 is a side elevation of a finishing plank.
Figure 10:
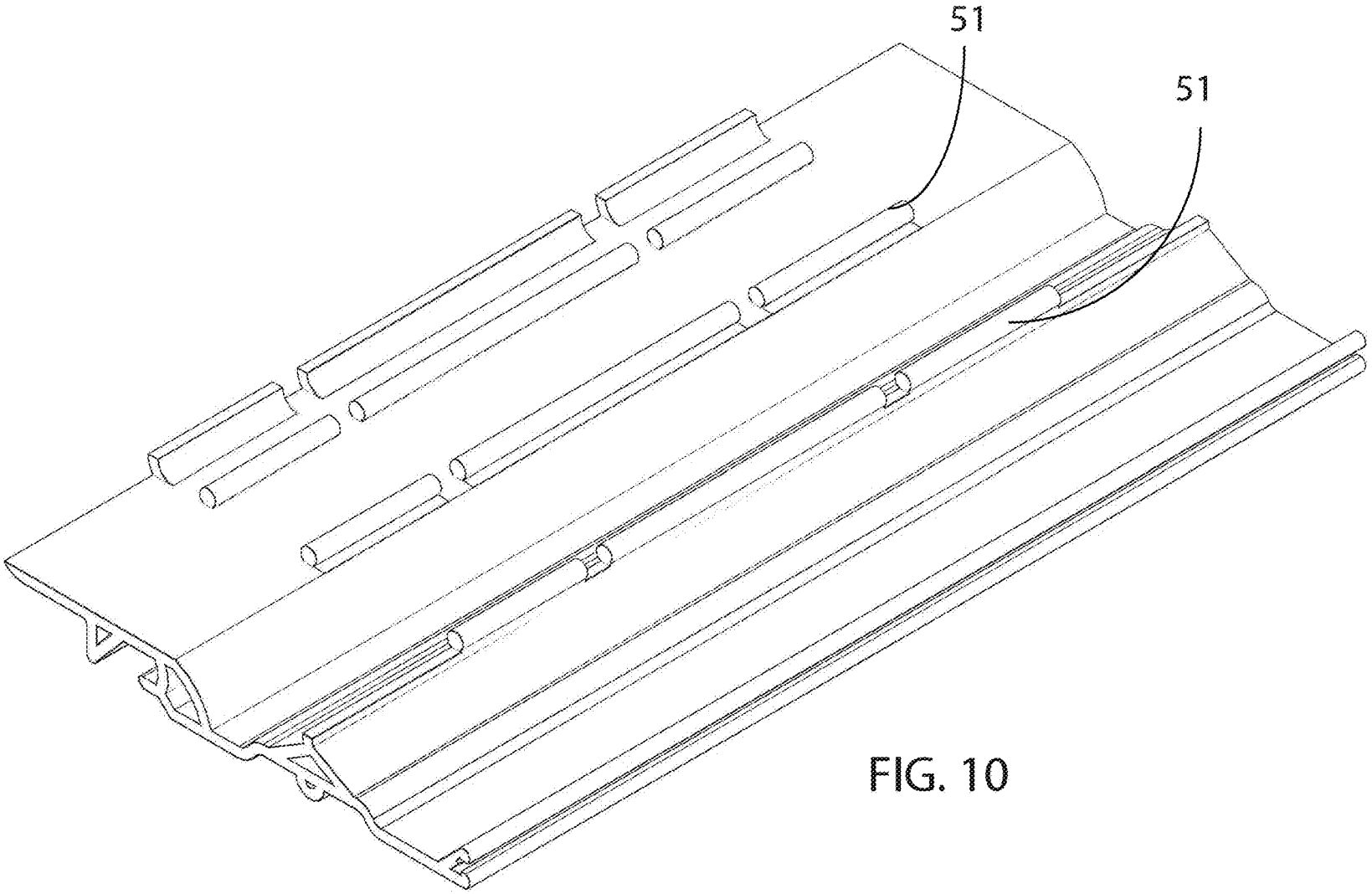
FIG. 10 is a rear perspective view of the siding plank component of FIG.
Figure 11:
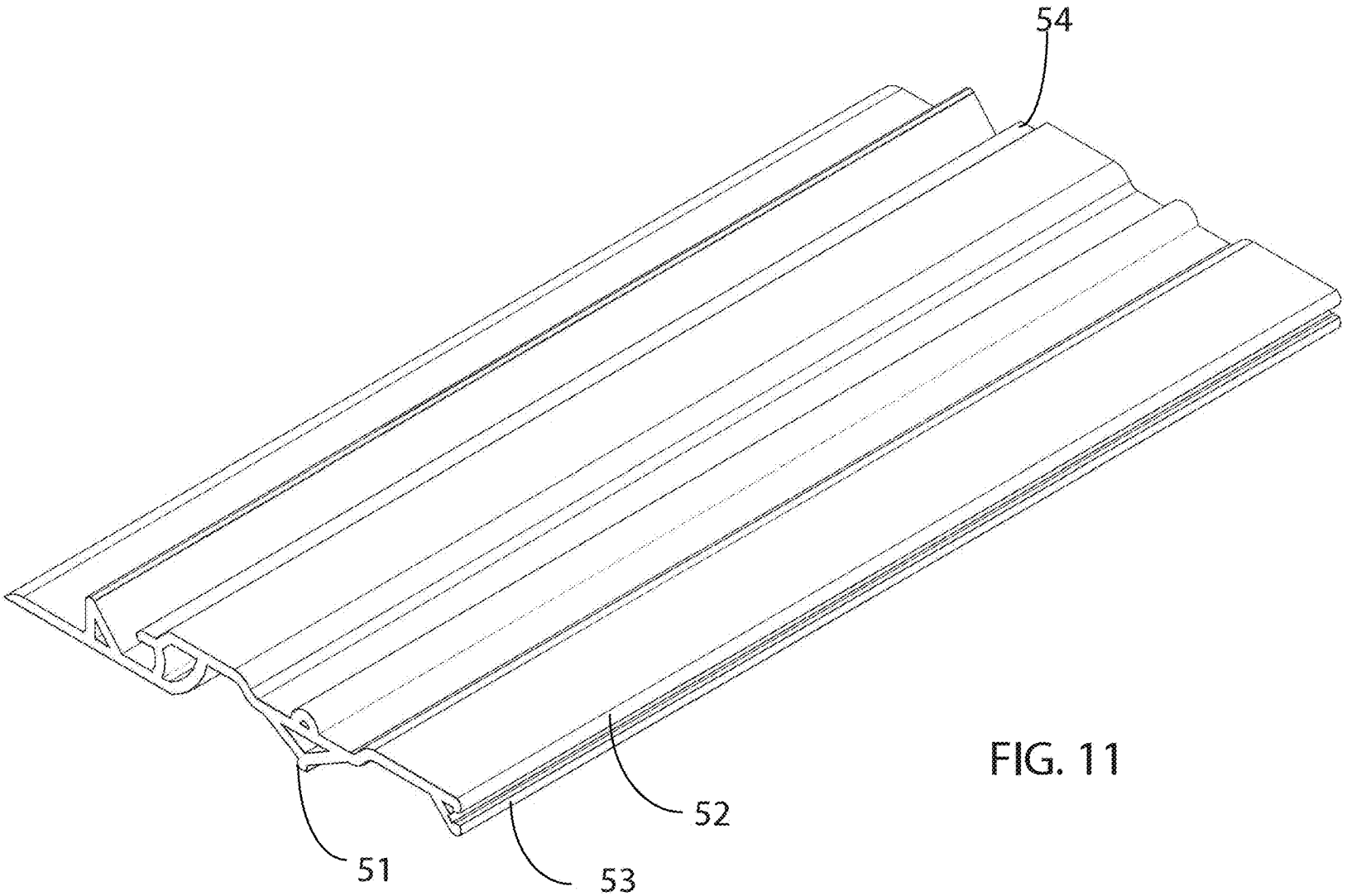
FIG. 11 is a front perspective view of the siding plank component of FIG. 8.
Figure 12:
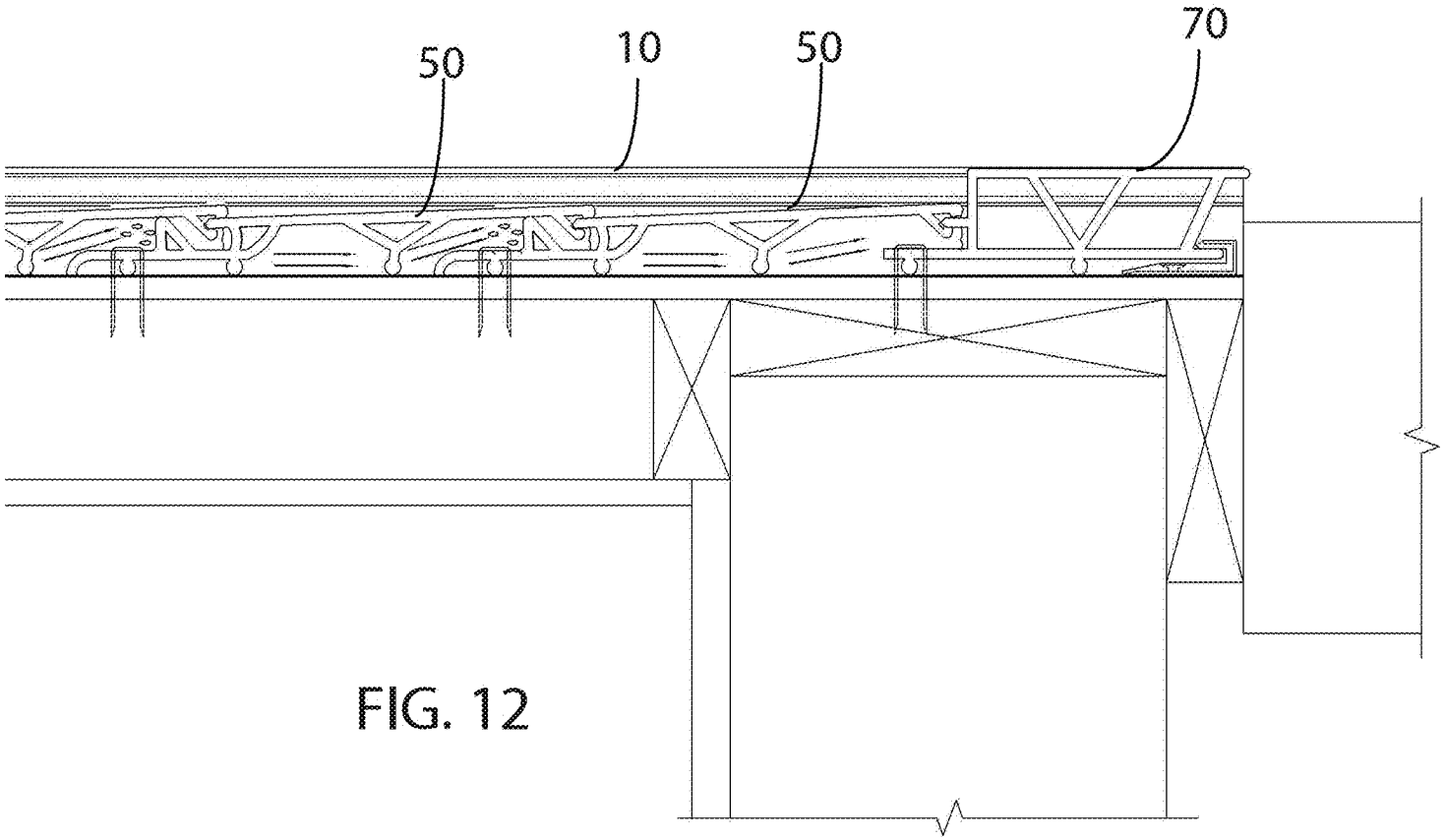
FIG. 12 is a sectional view detailing the assembly of siding plank components according to the present invention.
Figure 14:
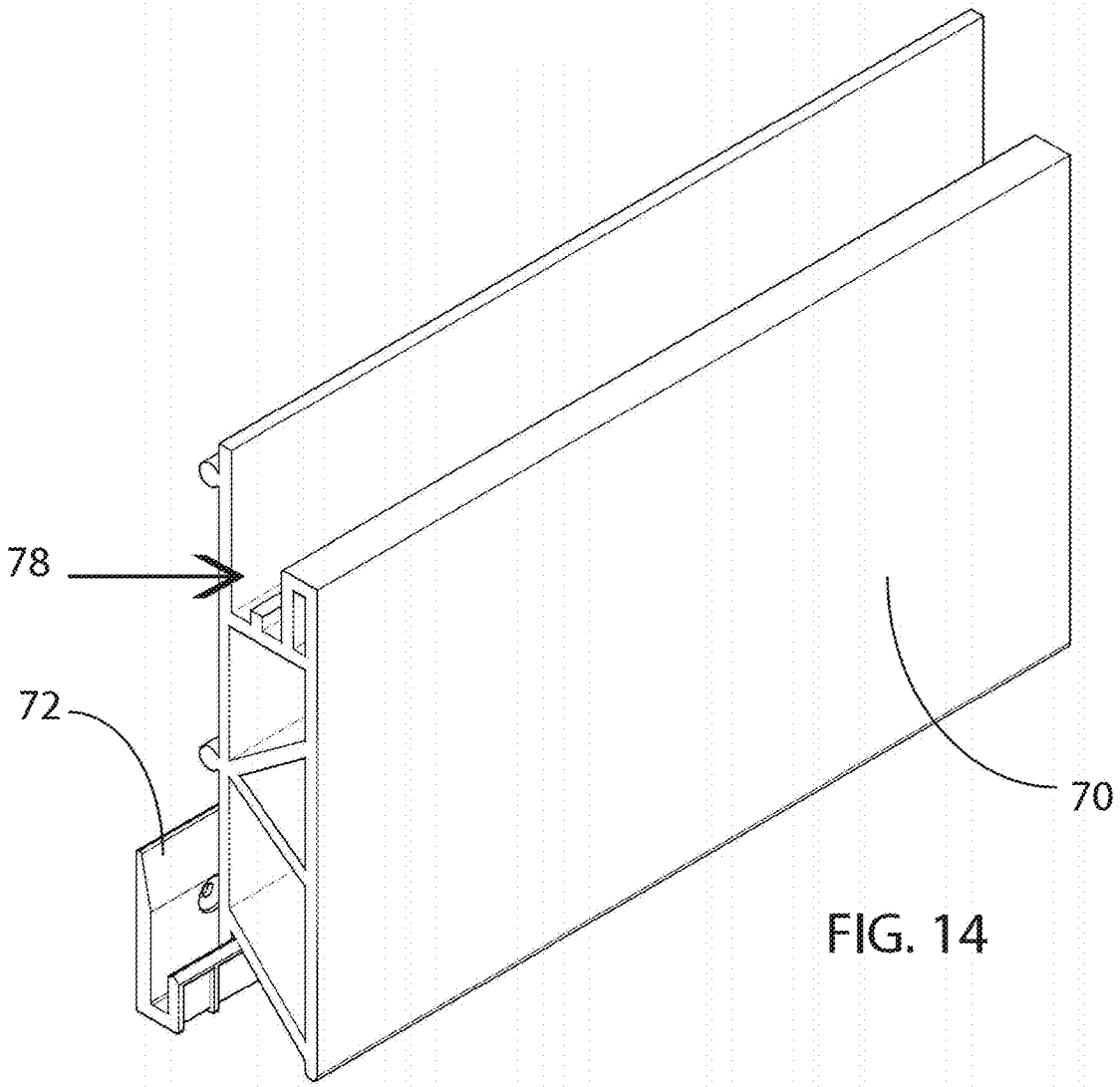
FIG. 14 is a perspective view of one embodiment of a base apron for use with the present invention.
Figure 16:
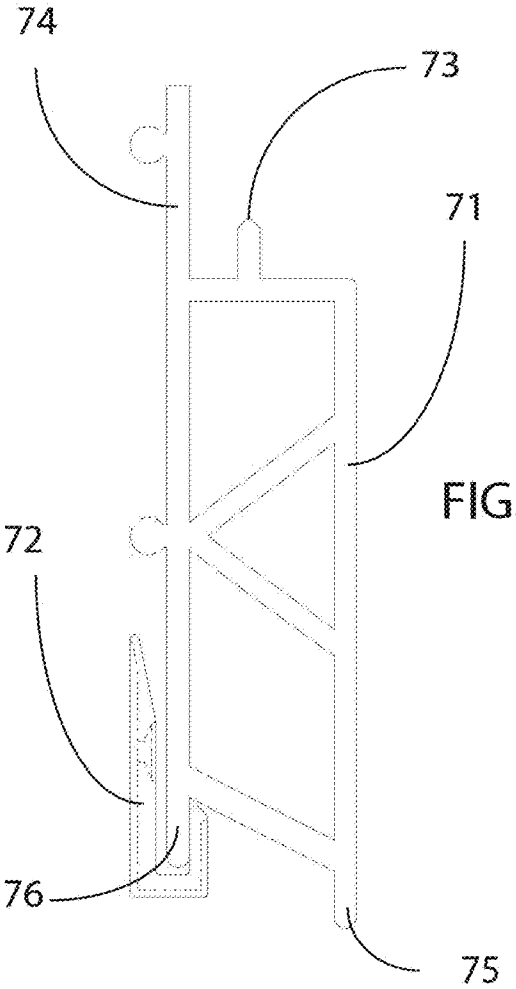
FIG. 16 is a side elevation of anther embodiment of a base apron according to the present invention.
Figure 15:
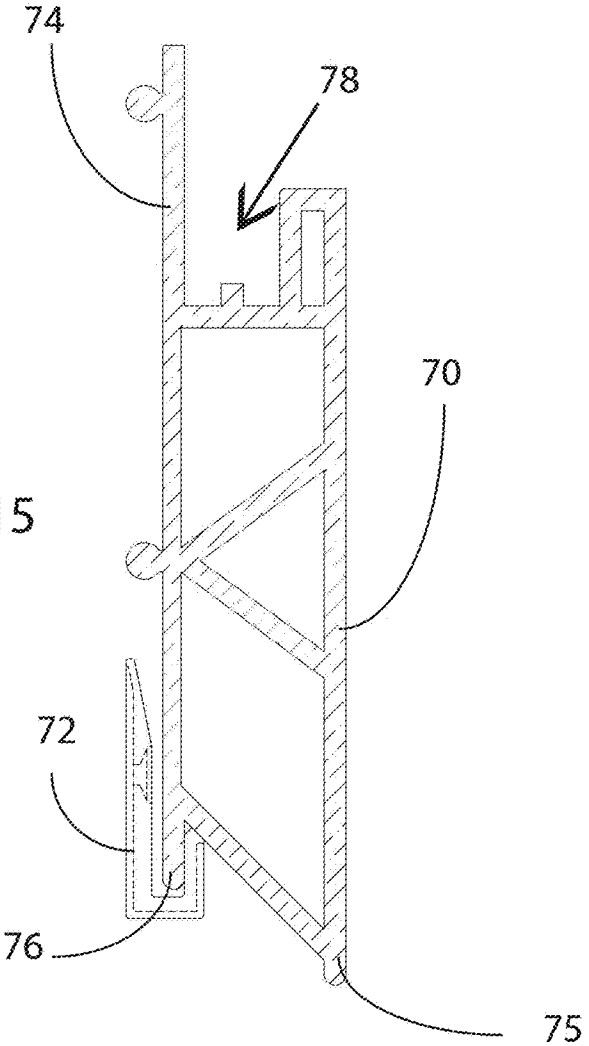
FIG. 15 is a sectional view of the base apron of FIG. 14.
Figure 17:
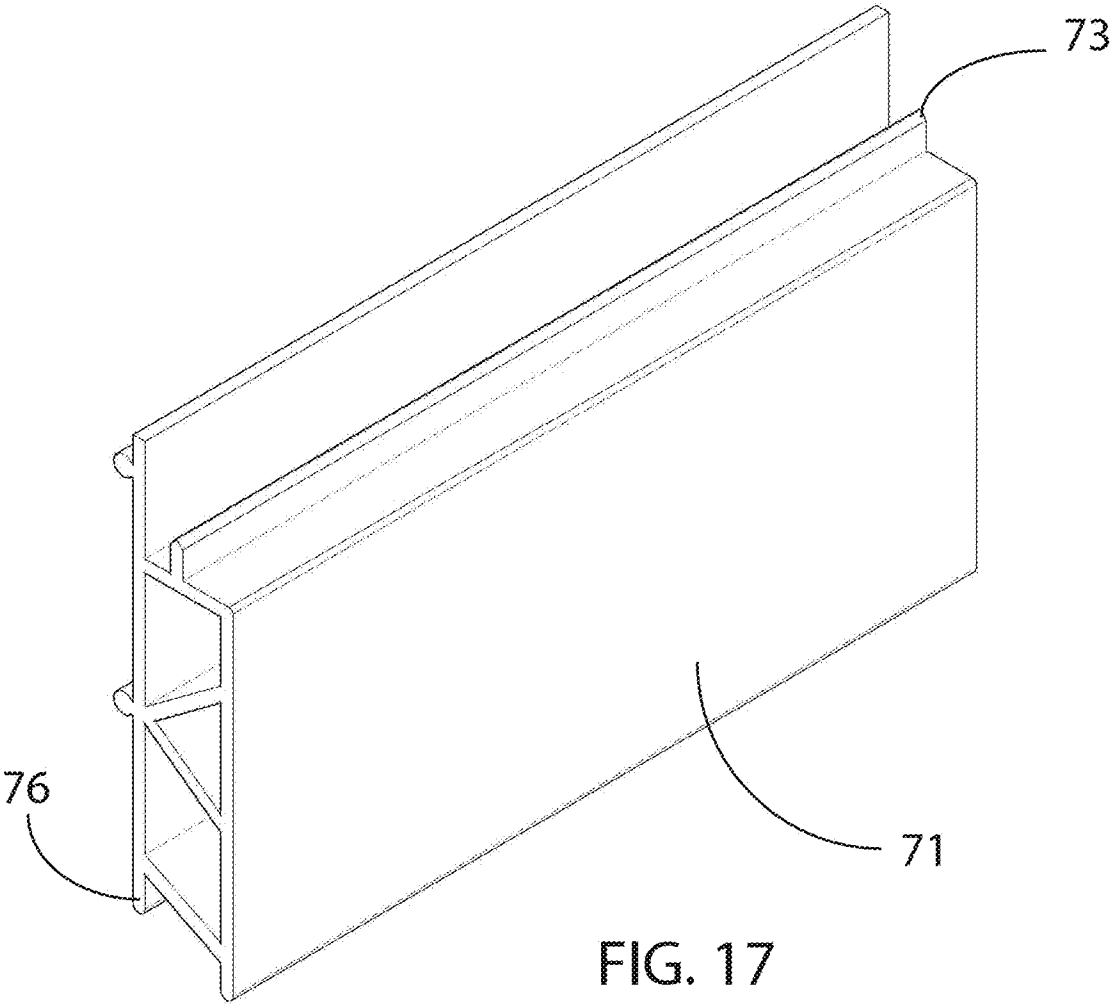
FIG. 17 is a perspective view of the base apron of FIG. 16.
Figure 21:
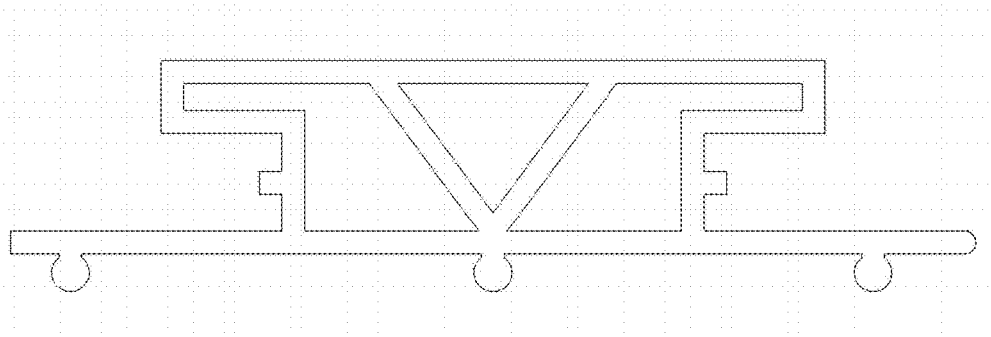
FIGS. 18-21 are side elevations of four different embodiments of mid-wall aprons for use with the present invention.
Figure 20:
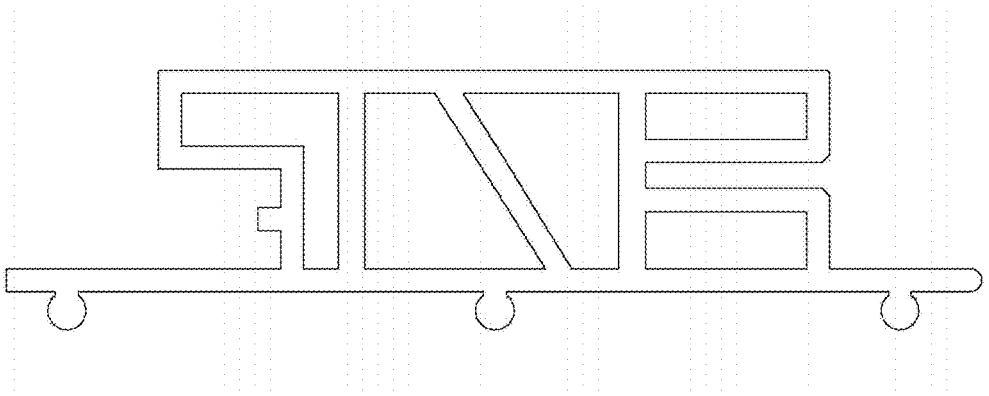
Figure 19:
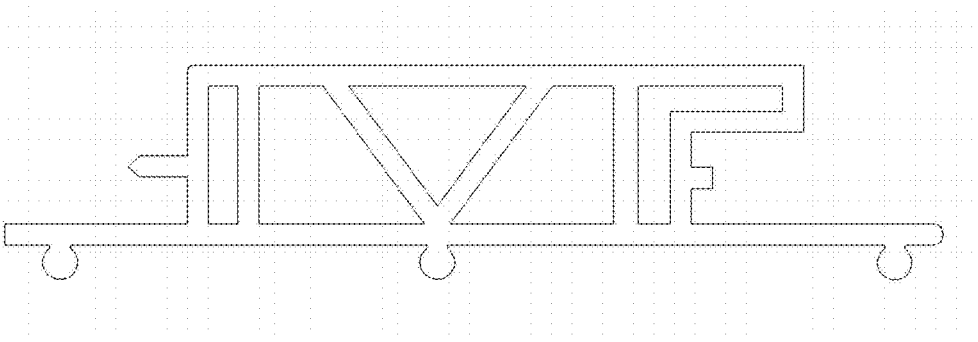
Figure 18:
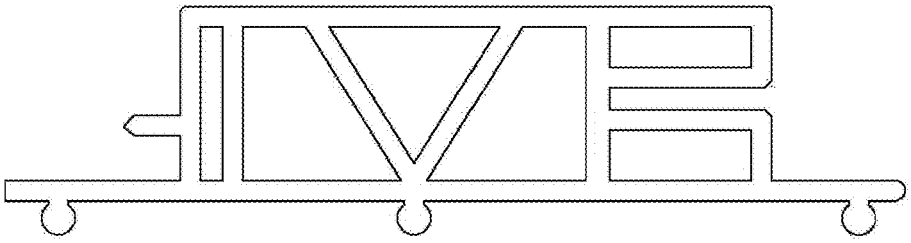

The plank interface is different than the standard interface and is utilized for horizontal siding planks 50 and those aprons and trim components interfacing therewith. As the siding planks (FIGS. 7-12) are used to create a sloping shingled appearance, the plank interface has an attachment spur 56, which co-operates with the lower edge 52 of a plank to receive an upper edge 54 of a plank beneath it. The attachment spur 53 and panel are made to snap onto the top edge of the lower panel, thanks to lips provided on both the spur 53 and lower edge 52, and recline rearwards to that the bracket of the upper siding plank may be attached to the exterior wall. The plank bracket 58 is of slightly different construction. Like the standard bracket, it has a flange 59 extending beyond the upper edge of the plank and a trough 57 disposed beneath that same edge (in fact, partially formed by the panel). A triangular spacer 55 is disposed on the flange 59 between the trough 57 and attachment strip and no spacer is in the trough. Ideally, the upper edge of the flange is hooked rearwardly to aid in the control of any water that may get behind the planks (as shown in FIG. 12). This feature may be used on any component with a horizontal flange, but is optional. When assembled, the narrow edges (as defined by being generally at a right angle to the bracket) of each plank are positioned in corresponding troughs of corner components or mullions. A finishing plank 50*a* (FIG. 13) is also provided which lacks the upper bracket and is designed to be cut to size and then the plank directly interfaces with finishing components, like frieze board, made to accept this piece. Since the plank interface has two distinct portions, an upper and a lower portion, any component made to interface with siding plank must have a portion of the interface dependent upon its location in relation to the siding plank (i.e. an apron underneath the plank will have the upper portion, essentially a connection spur, located on its upper edge while fascia finishing the wall will have a slot for receiving the upper edge of the finishing plank). Each plank 50 has a plurality of spacers 51 on its reverse side to help it stand off from the external wall 1. The shape of the plank 50 may be any readily conceived and manufactured, such as the flat shape seen in FIGS. 7, 8, 12 and 18 or the Dutch lab board shape of FIGS. 9-10.

Aprons are horizontal components of which there are three types. The base apron 70, 71 (FIGS. 14-17) runs along the bottom of the wall and provides support for the whole system. It is secured to the wall by the flange 74 and a support clip 72. The support clip 72 is one of the few components that is secured to the wall by larger screws. The base apron has an edge 76 designed to fit over a lip in the support bracket 72. There are two types of base aprons. One type 70 interfaces with board and batten panels with a trough 78. The other type 71 presents a spur 73 to interface with planks, as can be seen in FIG. 12. Both have a lower edge 75 that extends beneath the level of the bracket 72.

The mid-wall apron 80 is used to break up the pattern established by the coverage planks. It must therefore have bottom 82 and top 84 interfaces for the coverage planks. As such, each mid-wall apron will have either a plank interface or a standard interface as either the top or bottom interface, for four possible configurations, as is illustrated in FIGS. 18-21.

Figure 22:
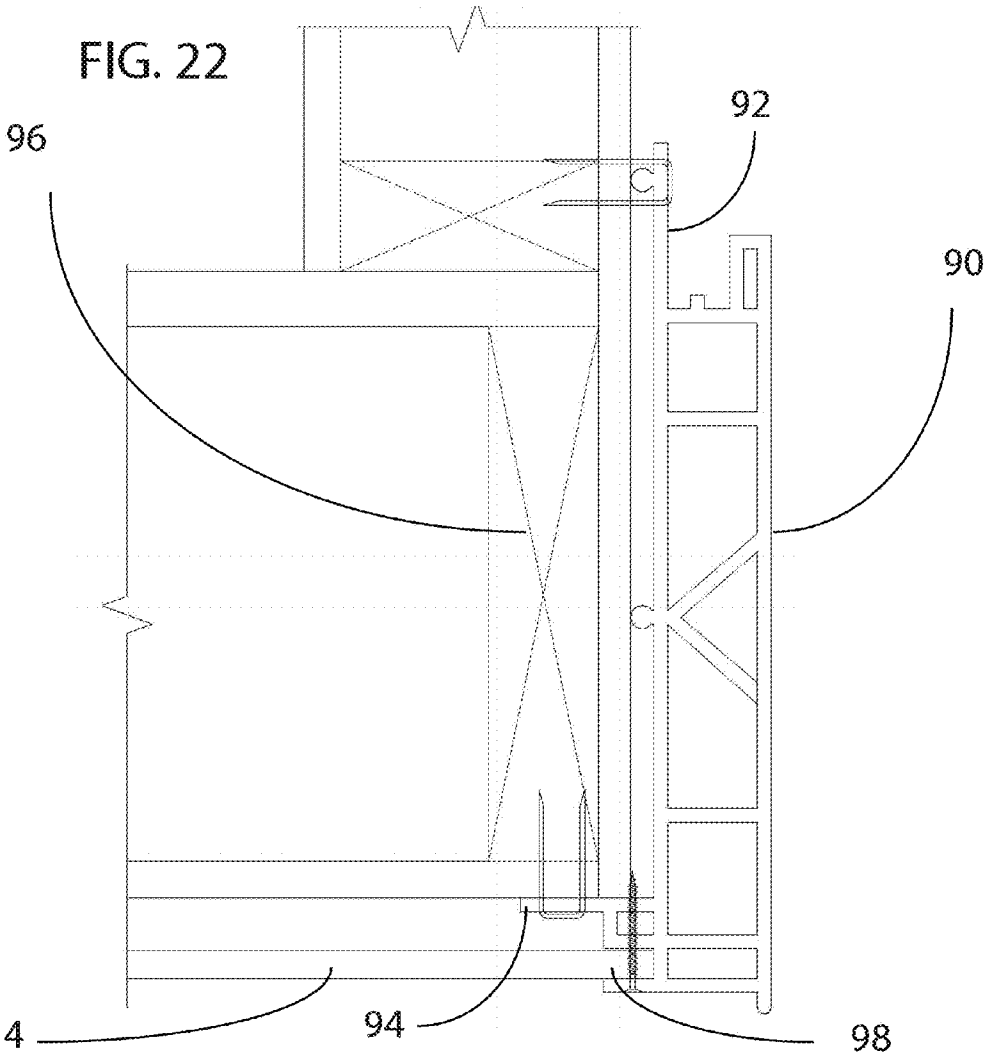
FIG. 22 is a sectional view of a cantilevered apron, installed, for use with the present invention.

Cantilever aprons 90, as shown in FIG. 22, are used for areas on an exterior which project outward 96 from the general plane of the wall (such as for a bay window). Like the other aprons, it presents an upper flange 92 with one of the two horizontal connection interfaces. However, towards its bottom is a second flange 94 which extends rearward so as to allow the apron to fit around the corner of the projection 96. Slightly beneath the rearward flange is a slot 98 for receiving soffit board 4. The slot 98 is beneath the lower edge of the apron 90.

Figure 23:
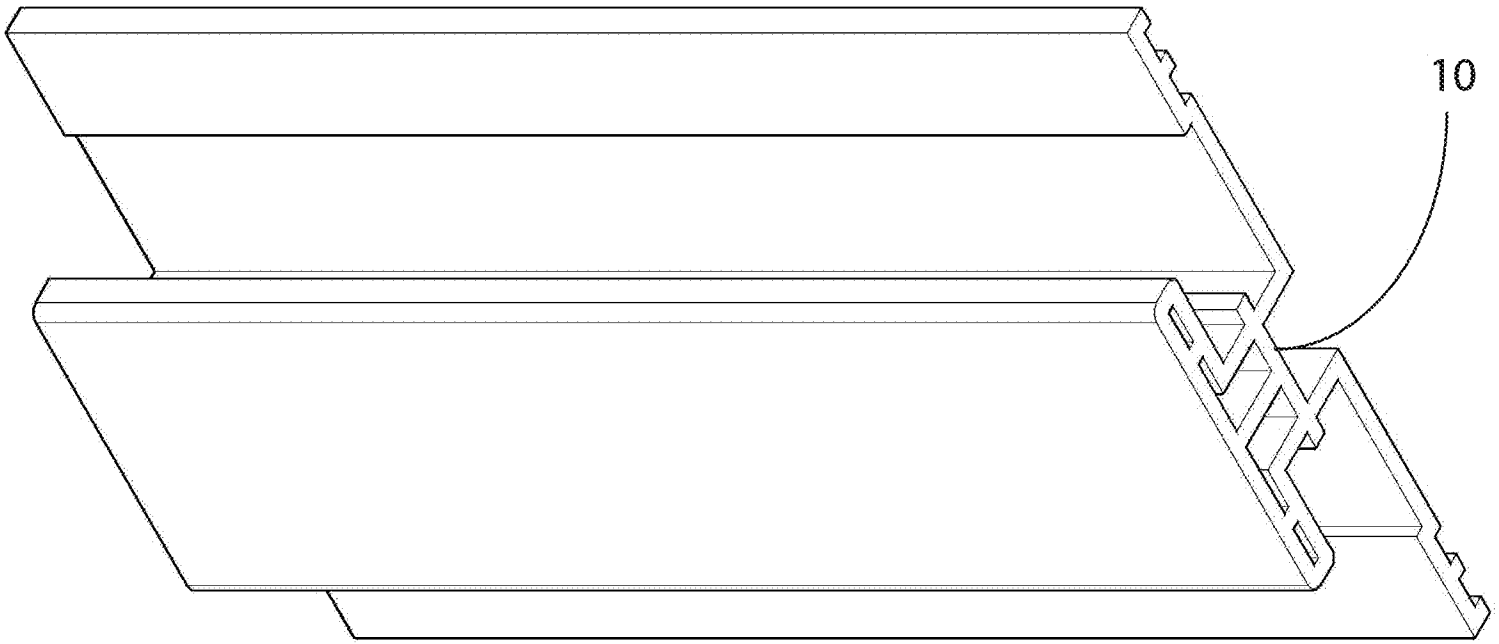
FIG. 23 is a perspective view of a mullion for use in the present invention.
Figure 24:
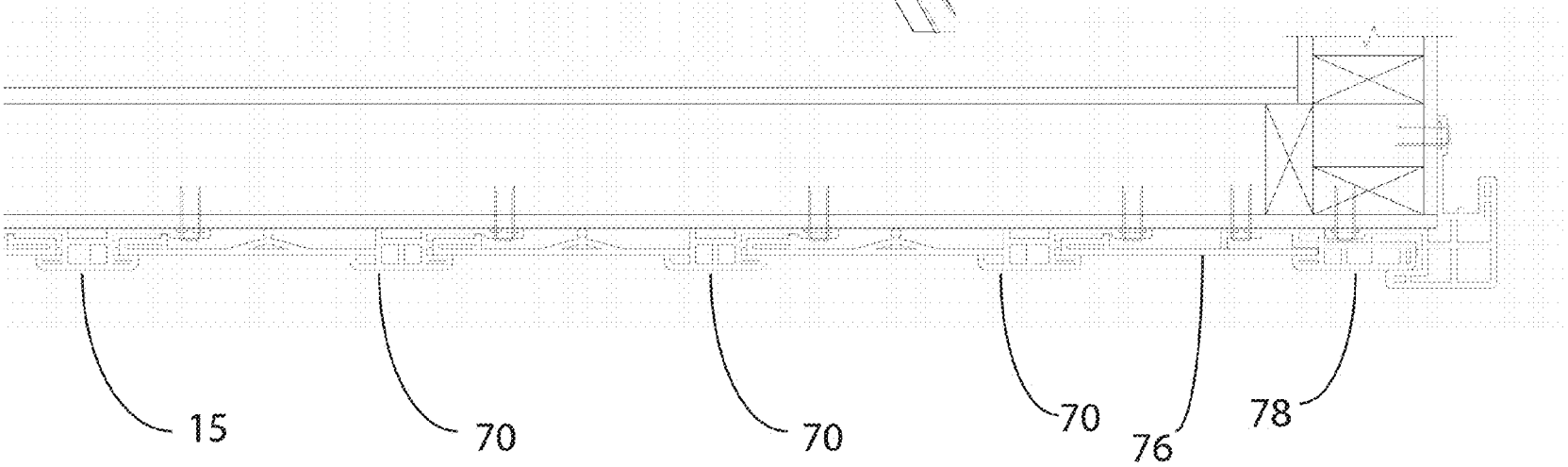
FIG. 24 is a sectional view of a board and batten assembly according to the present invention.
Figure 25:
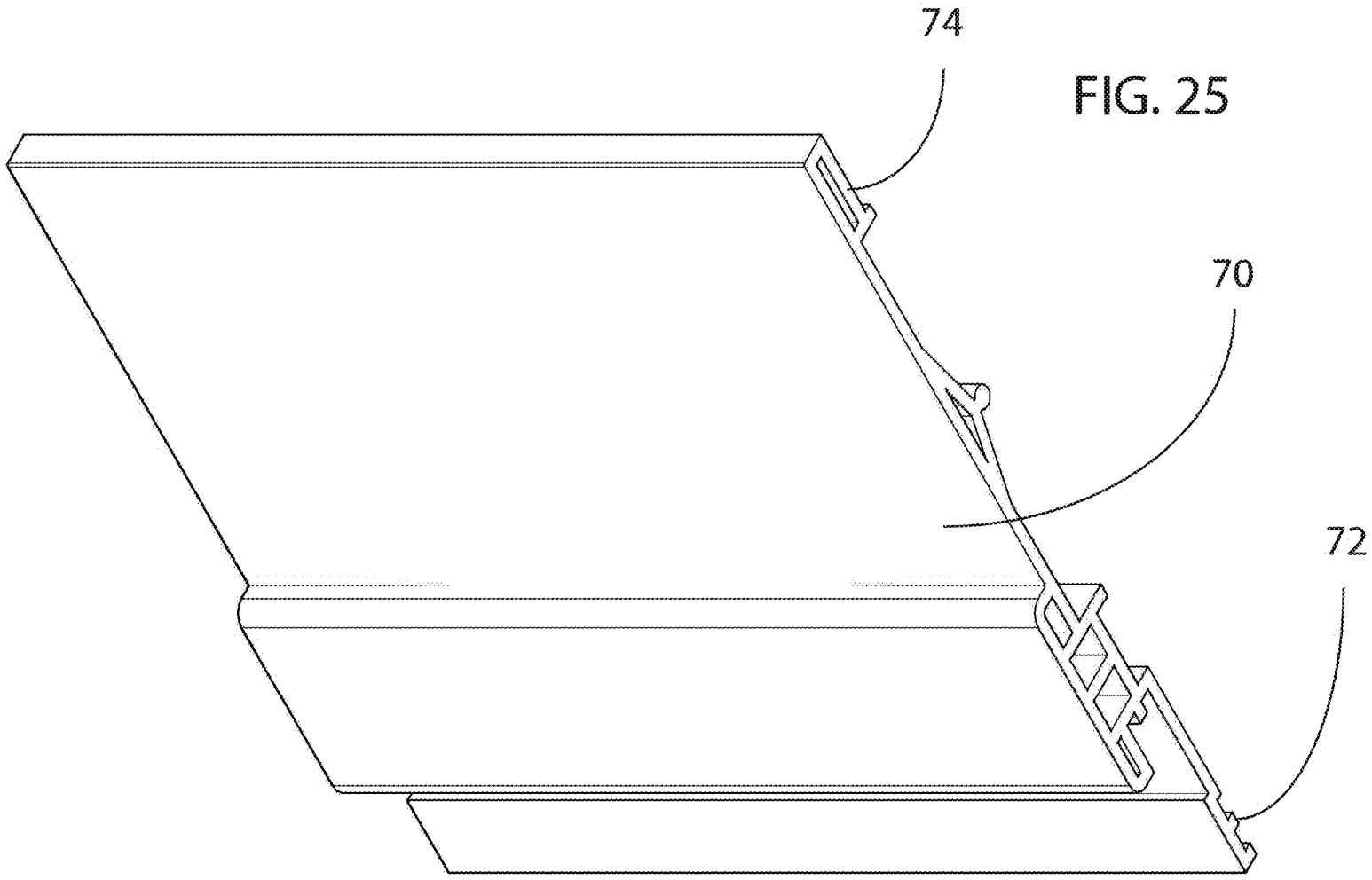
FIG. 25 is a board and batten plank used in the board and batten assembly of FIG. 24.
Figure 26:
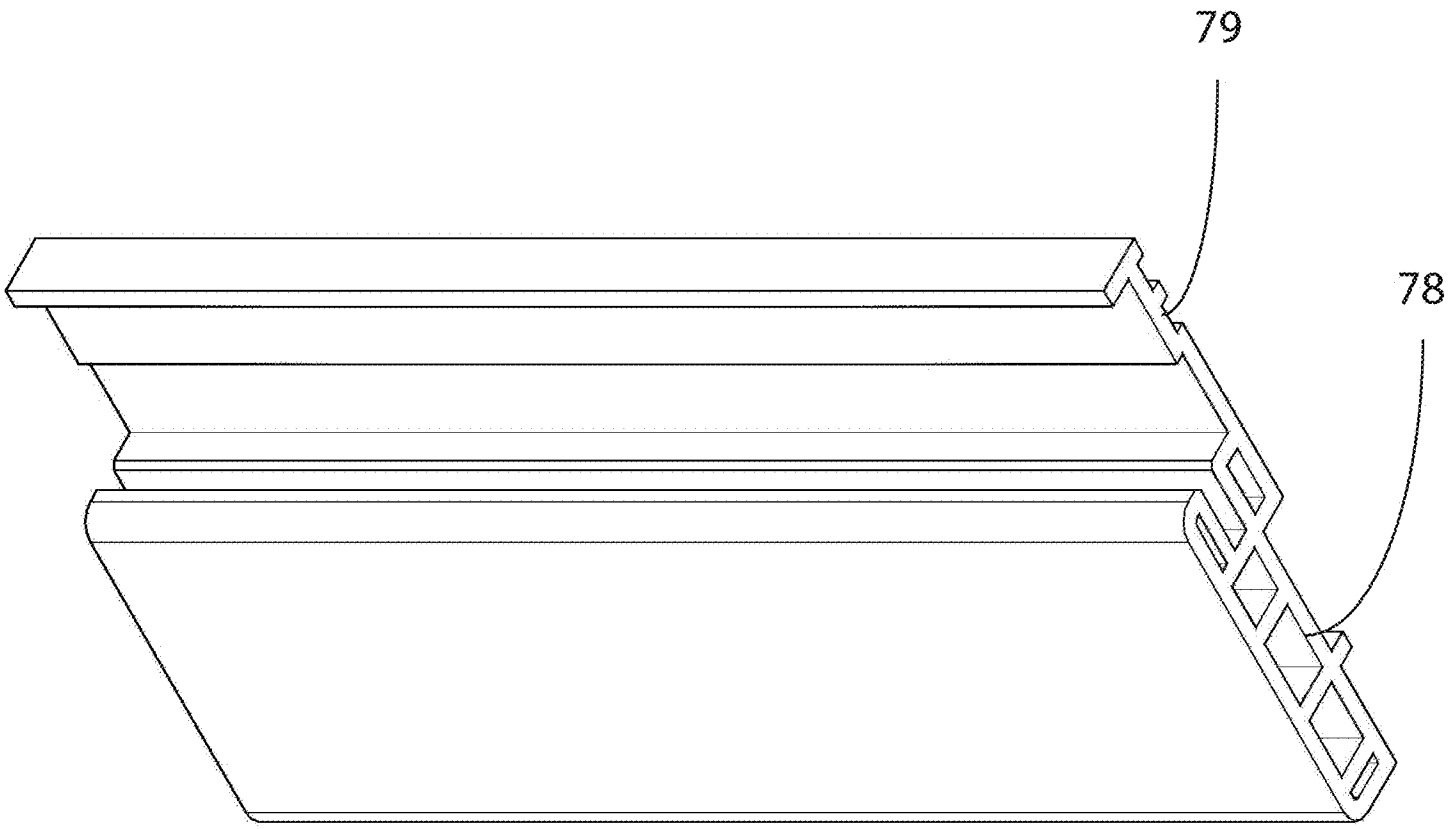
FIG. 26 is a batten used in the board and batten assembly of FIG. 24.
Figure 27:
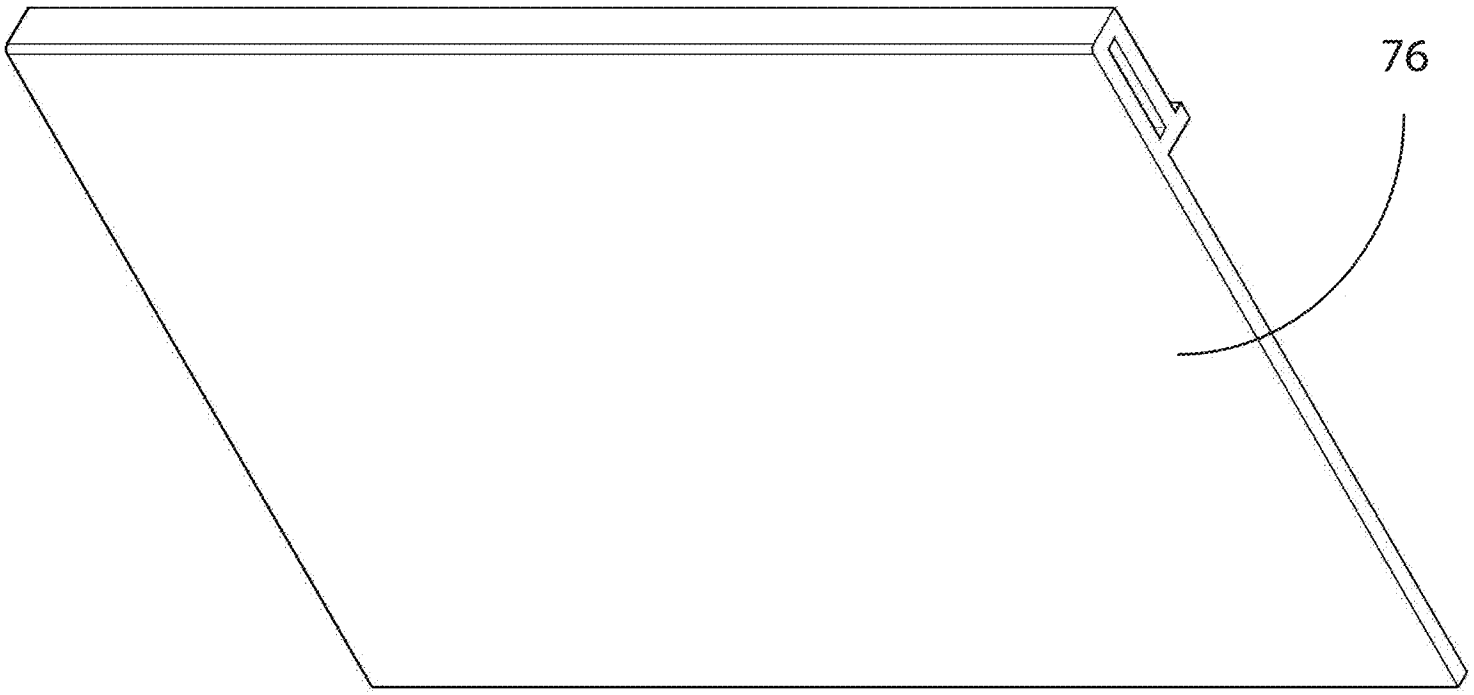
FIG. 27 is a board used in the board and batten assembly of FIG. 24.
Figure 28:
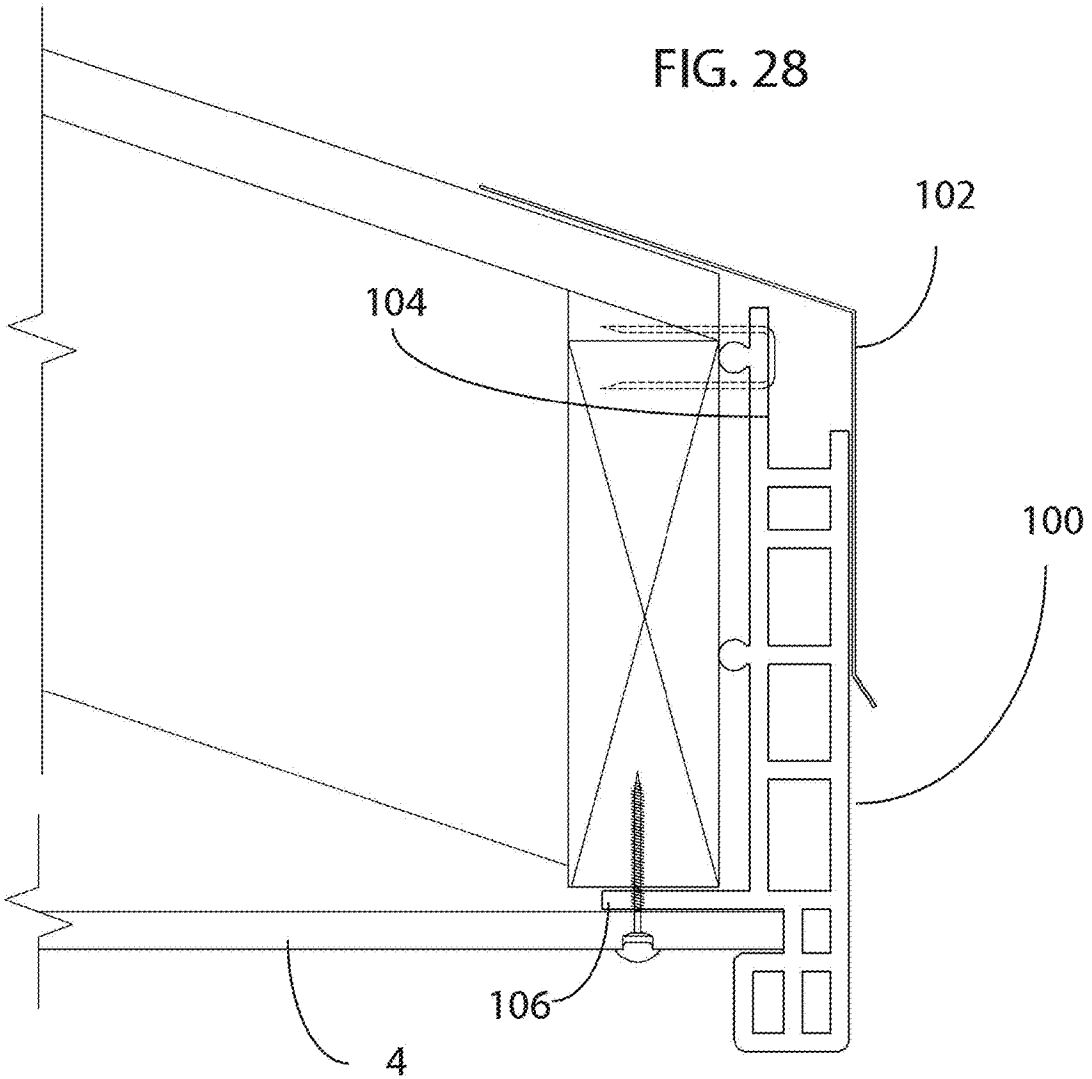
FIG. 28 is a sectional view of a fascia pice utilized with the present invention.

Mullions 10 (FIG. 23) are provided so as to allow tie-ins of planks or batten and boards. They contain the standard vertical interface on either side of the mullion. Mullions may be made in any shape, including a shape to match board and batten panels 15 (FIG. 24).

Board and batten panels 70 (FIGS. 24-27) have their extending flange 72 projecting on the batten side with a standard receiving trough. The board side of the panel terminates in a block 74 which rests in the standard receiving trough of a neighboring board and batten panel or a mullion or corner. For flexibility, a two-piece finishing panel construction is provided. The two piece panel is a board 76 which may be trimmed to size and a batten 78 which has a slot to receive the edge of the trimmed board and fits in the receiving trough of a corner or mullion. A flange 79 extends from the batten underneath the board 76.

Figure 29:
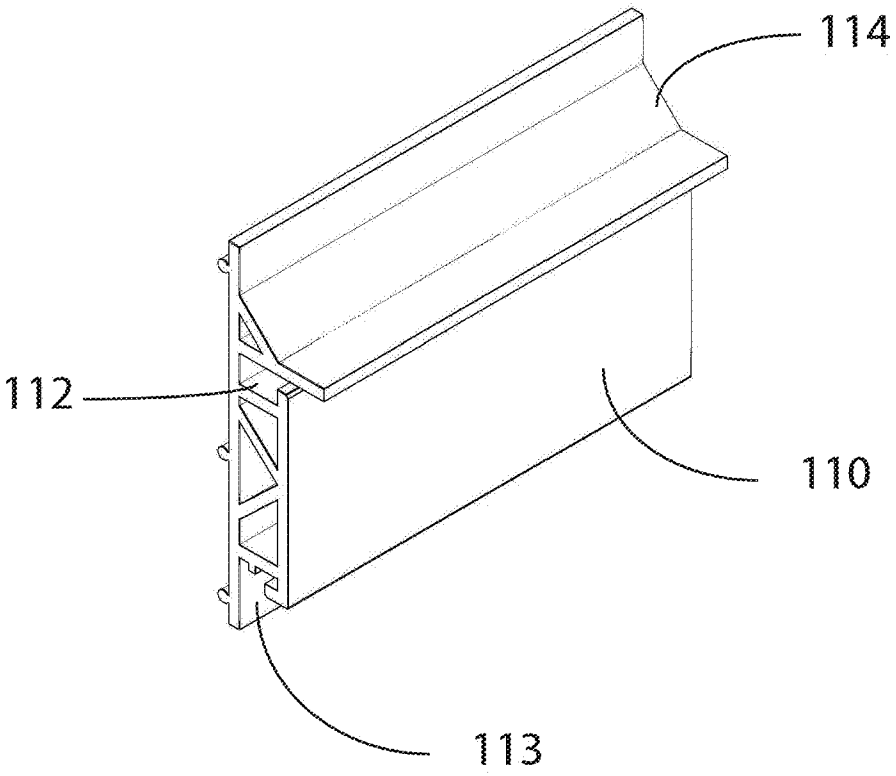
FIG. 29 is a sectional view of a frieze board utilized with the present invention.
Figure 30:
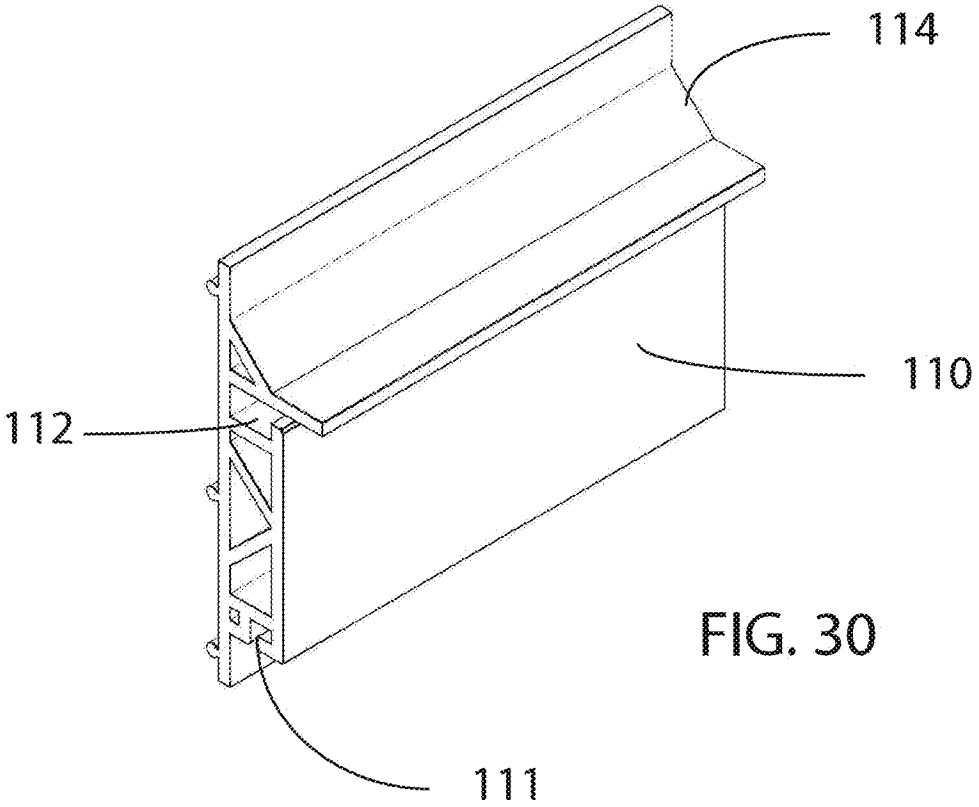
FIG. 30 is a perspective view of an alternate frieze board utilized with the present invention.
Figure 31:
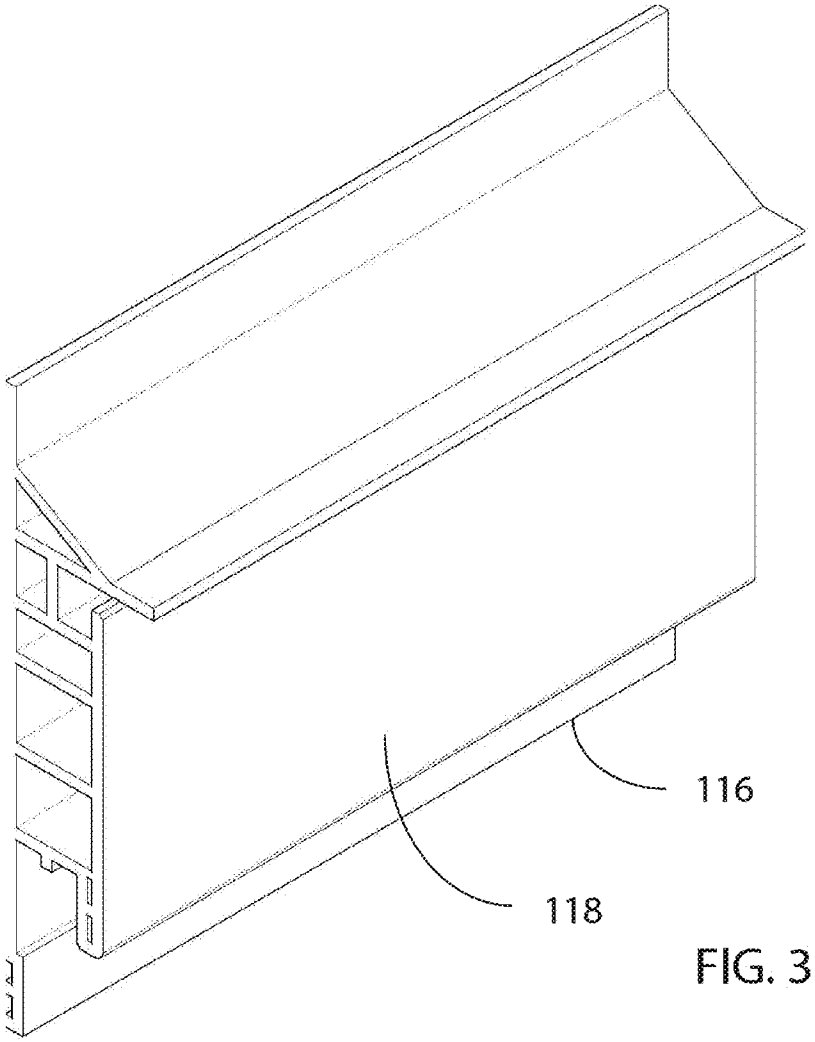
FIG. 31 is a perspective view of a third alternate frieze board for use with the present invention.
Figure 32:
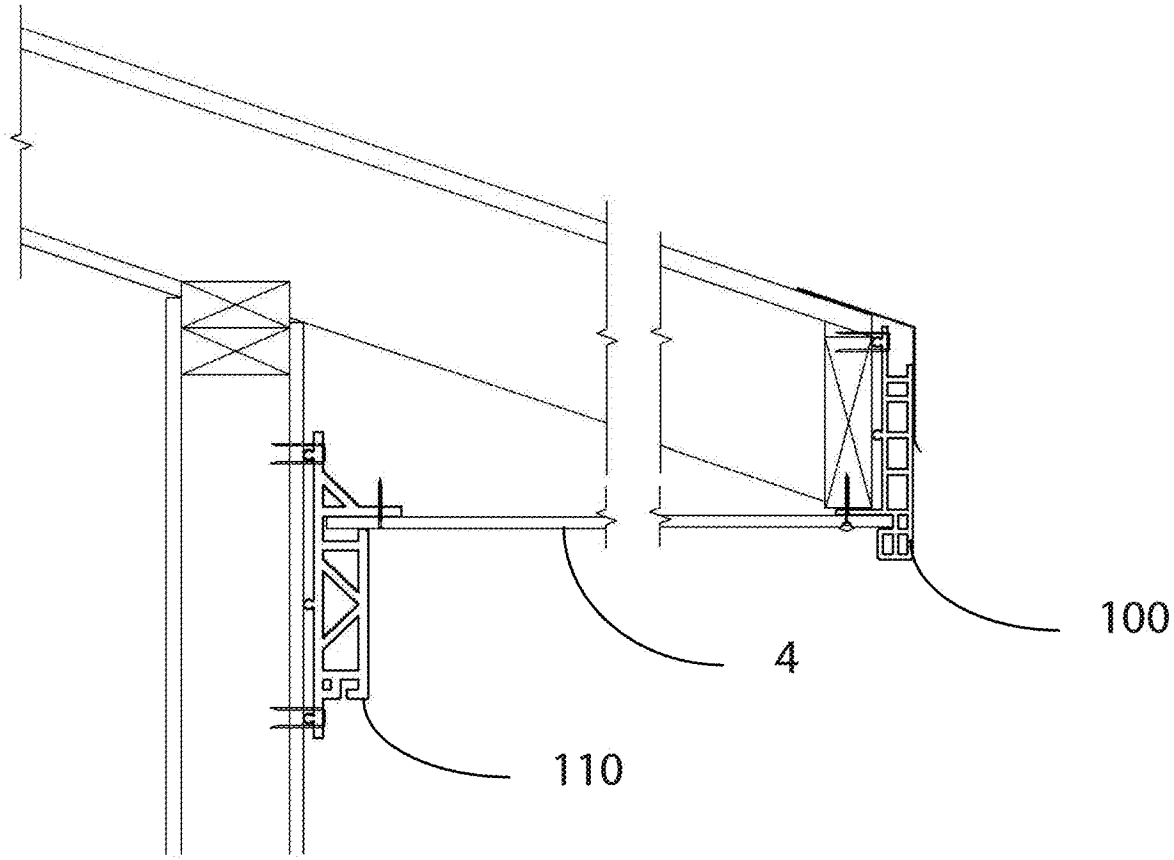
FIG. 32 is a sectional view of an assembly of a frieze board and fascia utilized in the present invention.

Finishing fascia 100 is provided to finish the area along the roof line of the building. Flashing 102 is provided to transition the top of the roof to the fascia 100, thereby hiding the upper flange 104, which contains a trough. Like the cantilevered apron, the fascia presents a rearward flange 106 and a slightly lower slot for soffit board 4. Frieze board 110 finishes the top of the wall and may have a lower interface to either fit plank panels 111 (FIG. 30) or board and batten panels 113 (FIG. 29). It presents a corresponding slot 112 for soffit board 4 slightly underneath its upper flange 114. Frieze board may be horizontal 110 or gabled 118 (FIG. 31) with the lower edge 116 angled to accommodate the slope of the roof and the corresponding interface with coverage components. Soffit board 4 then fits between the frieze board 110 and the fascia 100 (FIG. 32) or a cantilevered apron.

Figure 33:
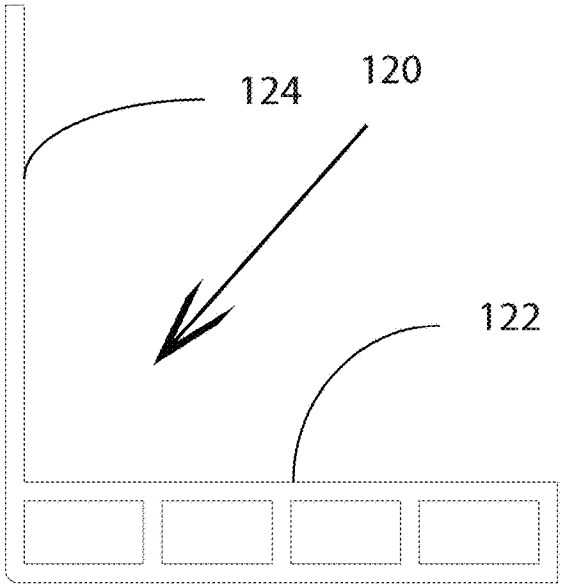
FIG. 33 is a top plan view of a garage door extension jamb utilized with the present invention.

Finishing the siding system around doors windows and garage doors required specialized parts. The simplest of these parts is the garage door extension jamb shown in FIG. 33. The jamb is simply a head 122 with a bracket 124 at a right angle thereto. The bracket 124 is fastened to the interior garage wall such that the head 122 proceeds outward, where it may be cut to size and interface with any corner. This arrangement keeps the siding flush with the garage door.

Figure 34:
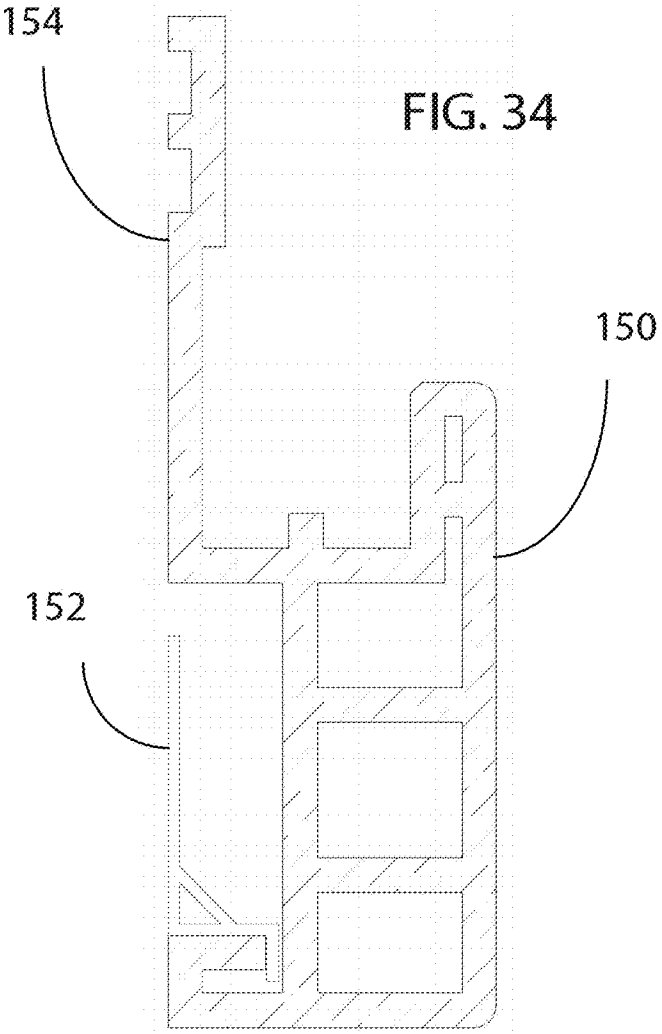
FIG. 34 is a sectional view of a door trim component for use with the present invention.
Figure 35:
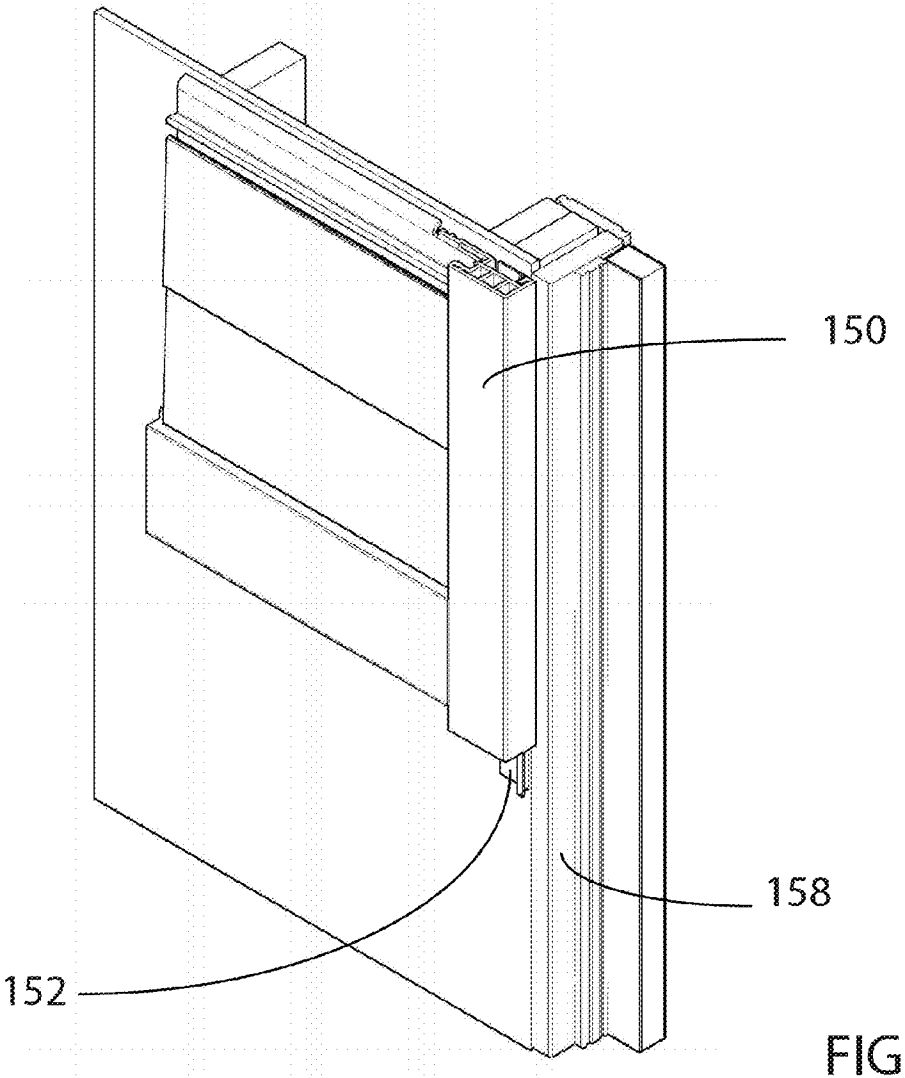
FIG. 35 is a perspective view of the door trim component of FIG. 34 installed about a door.

Similarly, a flashing bracket 152 is used to keep the door trim finishing components 150 flush with a door way (FIGS. 34 and 35). When installed at the edge of the doorway, the flashing bracket 152 positions the door trim 150 slightly overlapping the door jamb 158. With this arrangement, the trim stays evenly distributed down the door jamb. The door trim component 150 has a bracket 154 with the standard vertical trough interface 158.

Figure 36:
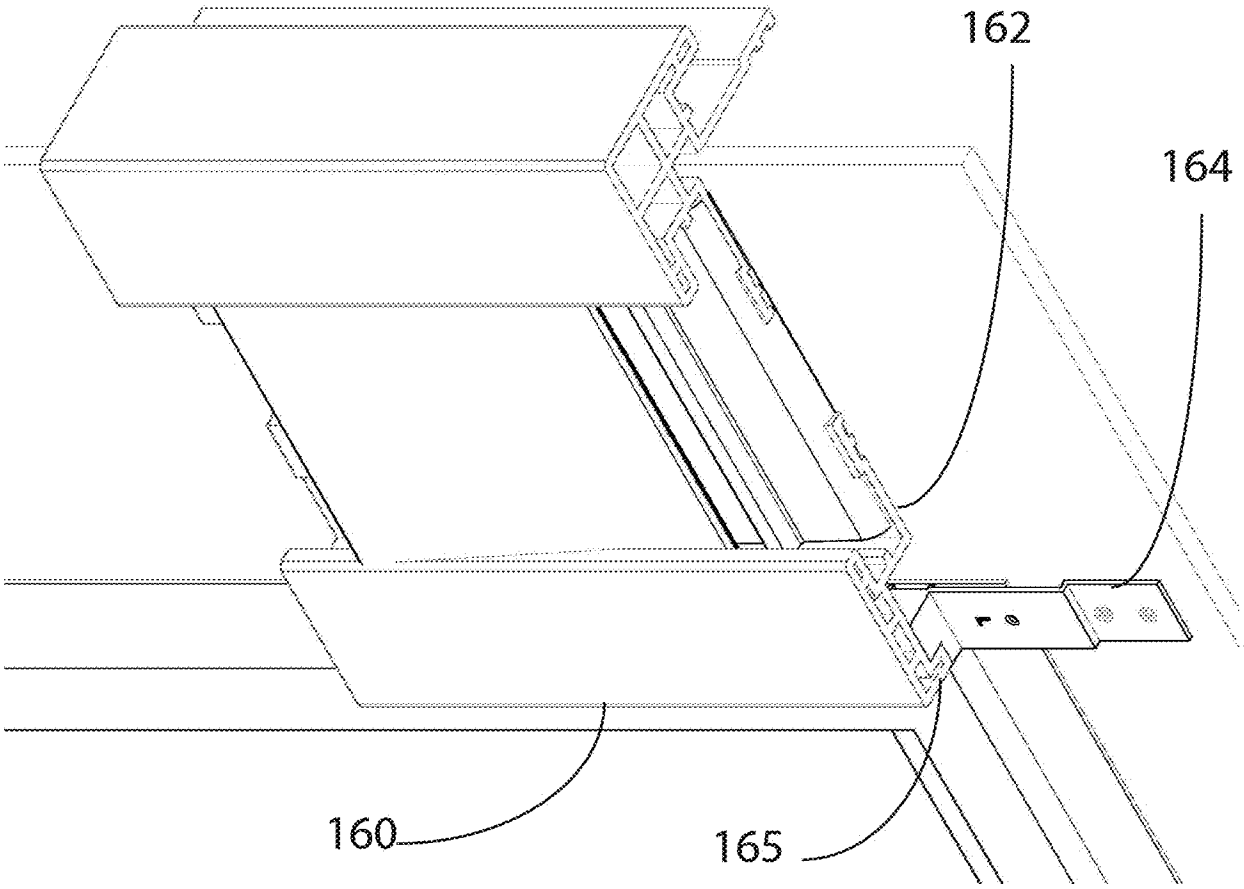
FIG. 36 is a perspective view of a window trim component for use with the present invention.
Figures 37, 38, 39:
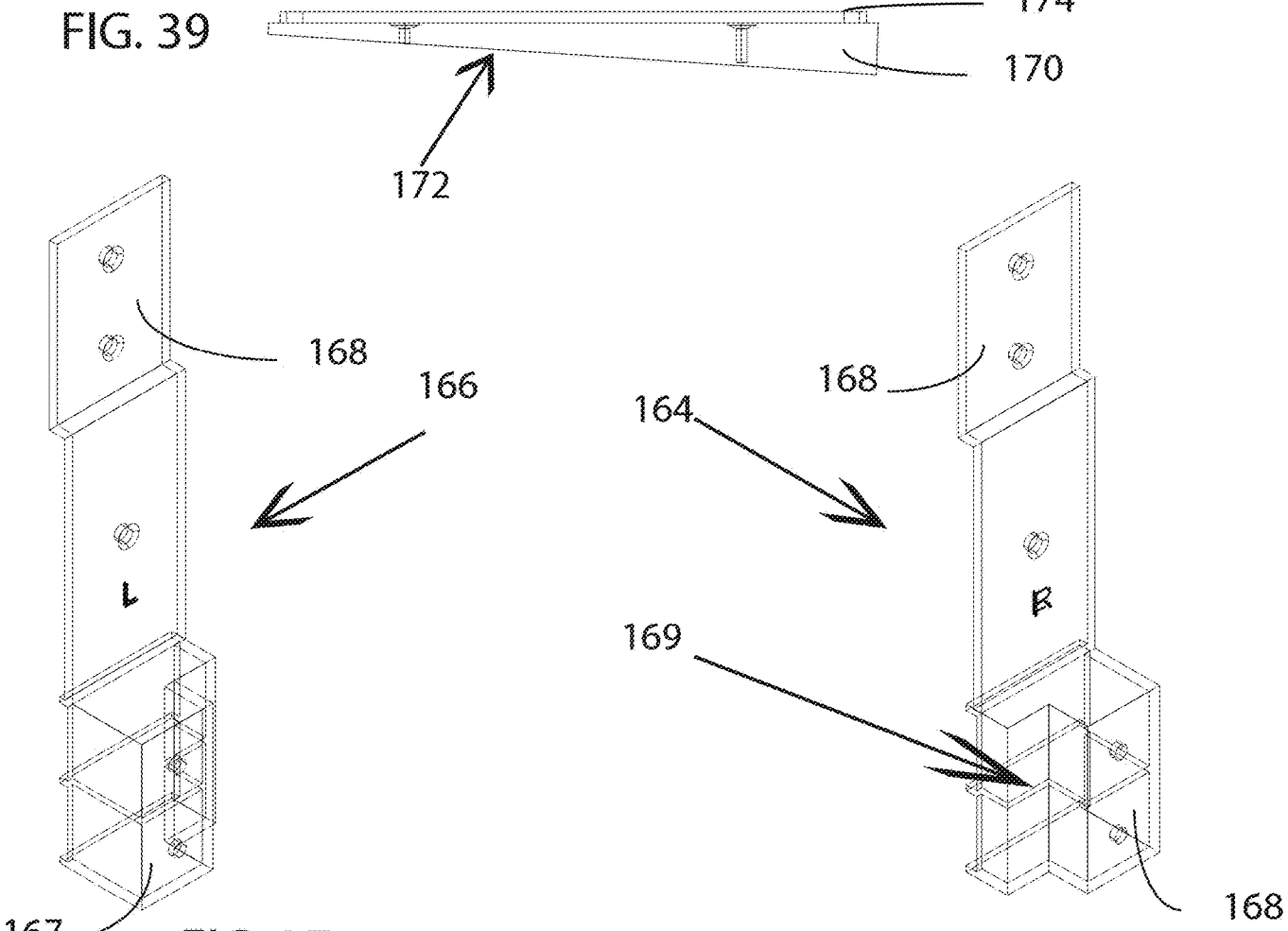
FIG. 37 is a perspective view of a left window bushing for use with the window rim of FIG. 36.
FIG. 38 is a perspective view of a right window bushing for use with the window rim of FIG. 36.
FIG. 39 is a side elevation of a shim for use with the present invention.

For window trim 160, bushings 164, 166 are used to secure the trim about a window (FIGS. 36-38). Bushings may be for the right side of a window (right 164) or the left (left 166). Each bushing has a brace 168 that extends above the bushing and has a body that is an L-shaped block 167 with a divot 169 on the side of the bushing opposite its identification (the divot is on the left side of the right bushings body). Bushings 164, 166 are attached to the exterior wall above the window such that the block 167 abuts the window frame, the divot 169 being proximate the frame. The window trim has the standard vertical interface trough 162 and a side the is made to interface with a hook 165 that mates with the corresponding divot 169 so that it resides in the divot next to the window frame. This structure keeps the trim 160 flush with the window frame and the trim itself is reversible for use on either side of the window. Siding may be installed to the very top and bottom edges of windows and doors. As such, headers and sills may be mounted directly on siding panels. In order for such sills and headers to be vertical on plank siding, shims 170 (FIG. 39) are used to level the base on which the sills and headers are placed. Shims may be made of any shape to comport with the shape of the plank. They have an angled side 172 and a flat side with an adhesive 174. Shims 170 are first secured to the plank, then the adhesive is used to secure the sill or header to the shim 170.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. In combination with a jamb, a siding component comprising:

a. a vertical siding panel with upper, lower and two side edges; and b. a bracket, attached to the siding panel, the bracket further comprising:

i. at least one flange extending beyond one side edge of the siding panel; and ii. at least one vertical trough for the collection and control of water;

wherein the siding component is only directly connectable to an exterior wall of a building at the flange, at a location on the flange beyond the one edge of the siding, the jamb further comprising a jamb bracket and a head perpendicular thereto such that the head is insertable into the vertical trough and the jamb bracket can be mounted along an inside region of a garage door opening.

* * * * *